US009335678B2

(12) United States Patent
Ozawa et al.

(10) Patent No.: US 9,335,678 B2
(45) Date of Patent: May 10, 2016

(54) IMAGE FORMING APPARATUS INCLUDING RETAINING PART FOR RETAINING MOVABLE GUIDE IN PRESCRIBED POSITION

(71) Applicants: Atsushi Ozawa, Nagoya (JP); Noboru Suzuki, Komaki (JP)

(72) Inventors: Atsushi Ozawa, Nagoya (JP); Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/091,456

(22) Filed: Nov. 27, 2013

(65) Prior Publication Data

US 2014/0153978 A1 Jun. 5, 2014

(30) Foreign Application Priority Data

Nov. 30, 2012 (JP) ..... 2012-263727

(51) Int. Cl.
*G03G 15/20* (2006.01)
*G03G 15/00* (2006.01)

(52) U.S. Cl.
CPC ..... *G03G 15/2028* (2013.01); *G03G 15/6573* (2013.01)

(58) Field of Classification Search
CPC ..... G03G 15/2028; G03G 15/2017; G03G 15/2032; G03G 15/2035; G03G 2215/00675; G03G 2215/00679; G03G 2215/0054; G03G 2215/00544; G03G 2215/00362; G03G 2215/00135
See application file for complete search history.

(56) References Cited

U.S. PATENT DOCUMENTS 4,671,644 A * 6/1987 Sumida ..... G03G 15/234 399/124
4,754,293 A * 6/1988 Aizawa ..... G03G 15/30 271/186
7,988,148 B2 * 8/2011 Tanioka ..... G03G 15/2035 271/264
2011/0044704 A1 * 2/2011 Uehara ..... G03G 15/6529 399/21

FOREIGN PATENT DOCUMENTS

JP 2010-217414 A 9/2010

OTHER PUBLICATIONS

Co Pending U.S. Appl. No. 14/091,369, filed Nov. 27, 2013.
Co Pending U.S. Appl. No. 14/091,417, filed Nov. 27, 2013.

* cited by examiner

*Primary Examiner* — Clayton E Laballe
*Assistant Examiner* — Victor Verbitsky
(74) *Attorney, Agent, or Firm* — Banner & Witcoff, Ltd.

(57) ABSTRACT

An image forming apparatus includes a discharge unit, fixing unit, movable guide, cover, and retaining part. The discharge unit discharges a sheet out of a main body. The fixing unit thermally fixes developer image deposited on the sheet to provide an image-fixed sheet. The movable guide is movable between a first position and second position. The movable guide guides one surface of the sheet in the first position. The movable guide exposes a conveying path in the second position. The cover is movable between an open position where the movable guide is exposed and a closed position where the movable guide is covered. The movable guide is in the first position while the cover moves from the closed position to the open position. The retaining part is configured to retain the movable guide in the second position after the movable guide moves from the first position to the second position.

16 Claims, 13 Drawing Sheets

IMAGE FORMING APPARATUS INCLUDING RETAINING PART FOR RETAINING MOVABLE GUIDE IN PRESCRIBED POSITION

CROSS REFERENCE TO RELATED APPLICATION

This application claims priority from Japanese Patent Application No. 2012-263727 filed on Nov. 30, 2012. The entire content of the priority application is incorporated herein by reference. The present application is closely related to a co-pending U.S. Patent Application (corresponding to Japanese Patent Application No. 2012-263712 filed on Nov. 30, 2012) and U.S. Patent Application (Japanese Patent Application Nos. 2012-263722 filed on Nov. 30, 2012, 2012-263715 filed on Nov. 30, 2012, and 2012-263720 filed on Nov. 30, 2012).

TECHNICAL FIELD

The present invention relates to an image forming apparatus.

BACKGROUND

A conventional electrophotographic image-forming device can form images on sheets of paper, by transferring toner images onto the sheets and thermally fixing the toner images in a fixing unit. One such image-forming device known in the art includes a paper guide disposed above the fixing unit. The paper guide can be pivoted relative to the housing of the fixing unit to expose a paper-extraction opening through which jammed sheets of paper can be extracted. With this construction, the operator can easily extract a recording sheet that becomes jammed in the fixing unit by rotating the paper guide open and pulling the sheet out of the housing through the paper-extraction opening.

SUMMARY

However, since the paper guide in the conventional image-forming device described above extends over the entire width of a recording sheet conveyed in the image-forming device and is capable of pivoting open and closed, the paper guide may jiggle or vibrate when a force is applied thereto, such as when a sheet of thick paper or another stiff recording sheet is being conveyed.

In view of the foregoing, it is an object of the present invention to provide an image-forming apparatus having a structure that facilitates the resolution of paper jams while being able to convey recording sheets with stability.

In order to attain the above and other objects, the invention provides an image forming apparatus includes a main body, sheet discharge unit, fixing unit, movable guide, cover, and retaining part. The sheet discharge unit is configured to discharge a sheet out of the main body. The fixing unit includes a heating member to thermally fix developer image deposited on the sheet to provide an image-fixed sheet. The movable guide is disposed near the heating member and defines at least a part of a conveying path for guiding the image-fixed sheet toward the sheet discharge unit. The movable guide is movable between a first position and a second position. The movable guide is configured to guide one surface of the image-fixed sheet in the first position. The movable guide is configured to expose the conveying path in the second position. The cover is disposed on a top of the main body and configured to move between an open position in which the movable guide is exposed and a closed position in which the movable guide is covered. The movable guide is disposed in the first position while the cover moves from the closed position to the open position. The retaining part is configured to retain the movable guide in the second position after the movable guide moves from the first position to the second position.

BRIEF DESCRIPTION OF THE DRAWINGS

The particular features and advantages of the invention as well as other objects will become apparent from the following description taken in connection with the accompanying drawings, in which:

FIG. 5(*b*) is a perspective view of the fixing unit when the movable guide part is in a second position;

FIG. 8(*b*) is an enlarged partial plane view of the fixing unit when the movable guide part if in the second position;

FIG. 9(*b*) is an explanatory diagram showing the movable guide part and the retaining part when the movable guide part is in the second position;

FIG. 10(*b*) is the fixing unit shown in FIG. 10(*a*) viewed in a direction indicated by arrow B;

FIG. 11(*b*) is a bottom perspective view of the frame member;

DETAILED DESCRIPTION

Next, an embodiment of the present invention will be described while referring to FIGS. 1 through 14. In the following description, a laser printer 1 serves as the embodiment of the image-forming apparatus, and directions related to the laser printer 1 are based on the perspective of a user operating the laser printer 1. Specifically, the left side of the laser printer 1 in FIG. 1 will be considered the "front," the right side the "rear," the near side the "right," and the far side the "left." "Top" and "bottom" sides of the laser printer 1 in the following description correspond to the vertical orientation of the laser printer 1 shown in FIG. 1.

Figure 1:
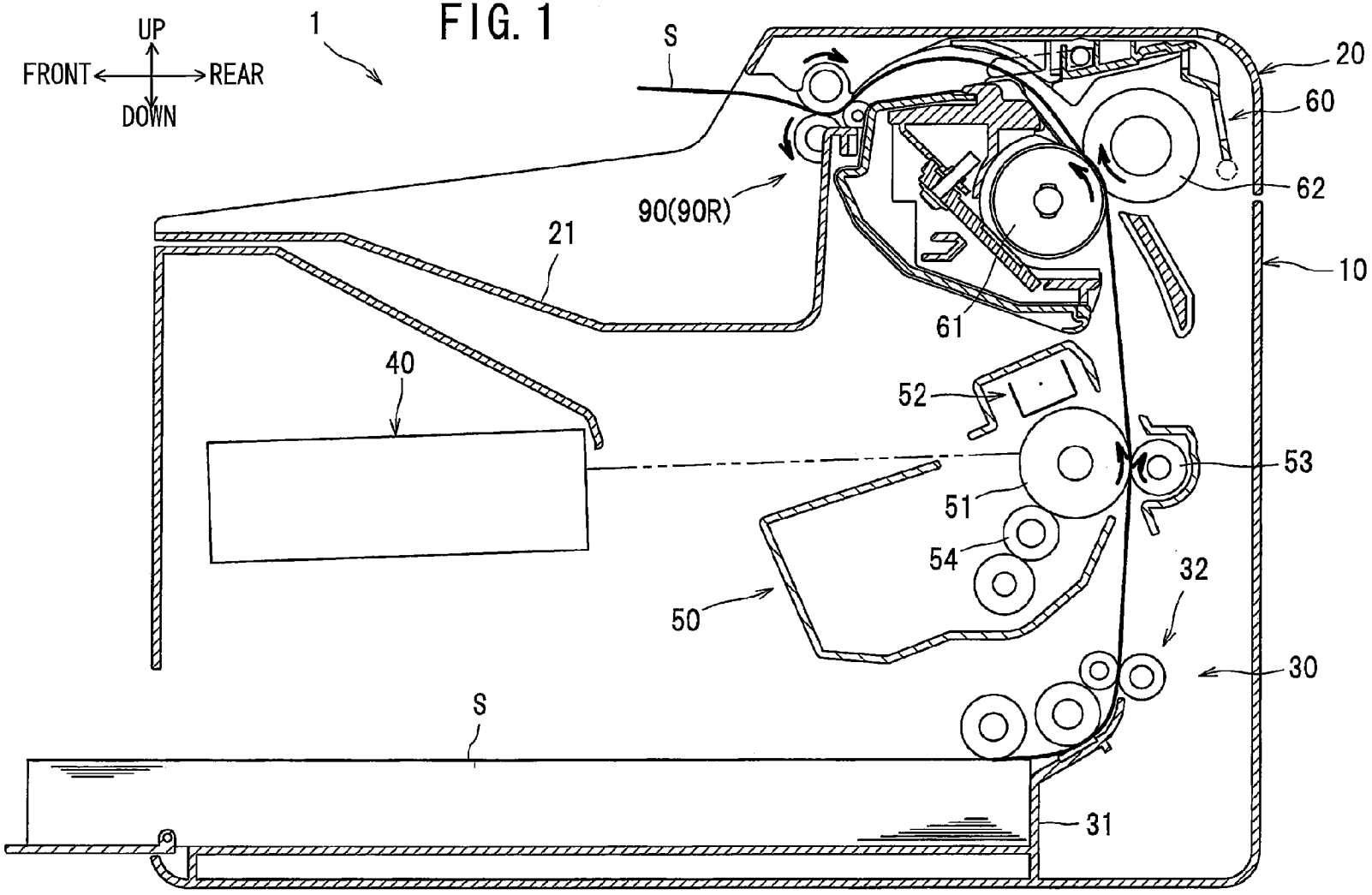
FIG. 1 is a cross-sectional side view of an image forming apparatus according to an embodiment of the present invention.

First, the overall structure of the laser printer 1 according to the embodiment will be described. As shown in FIG. 1, the laser printer 1 includes a main frame 10, and a top cover 20 disposed on top of the main frame 10. The top cover 20 is configured to move relative to the main frame 10 by rotating about its rear edge. A discharge tray 21 is formed on the top cover 20. Accordingly, the top cover 20 is movable between an open position and a closed position. In the open position shown in FIG. 2, an access opening 11 formed in the top of the main frame 10 is exposed. In the closed position shown in FIG. 1, the top cover 20 covers the access opening 11.

The laser printer 1 further includes a sheet-feeding unit 30, an exposure unit 40, a process cartridge 50, and a fixing unit 60 that are all accommodated inside the main frame 10, as well as a sheet discharge unit 90 that is configured to discharge sheets S from the main frame 10.

The sheet-feeding unit 30 is disposed in the bottom section of the main frame 10. The sheet-feeding unit 30 includes a paper tray 31, and a feeding mechanism 32. The paper tray 31 is configured to accommodate sheets S of paper. The feeding mechanism 32 separates the sheets S accommodated in the paper tray 31 and supplies the sheets S one at a time to the process cartridge 50.

The exposure unit 40 is disposed above the front side of the sheet-feeding unit 30. The exposure unit 40 includes a laser light source, a polygon mirror, lenses, and the like (not shown). The laser light source emits a laser beam based on image data. The laser beam is reflected off the polygon mirror, passes through the lenses, and is irradiated in a high-speed scan over the surface of a photosensitive drum 51 described later (see the double chain line in FIG. 1).

Figure 2:
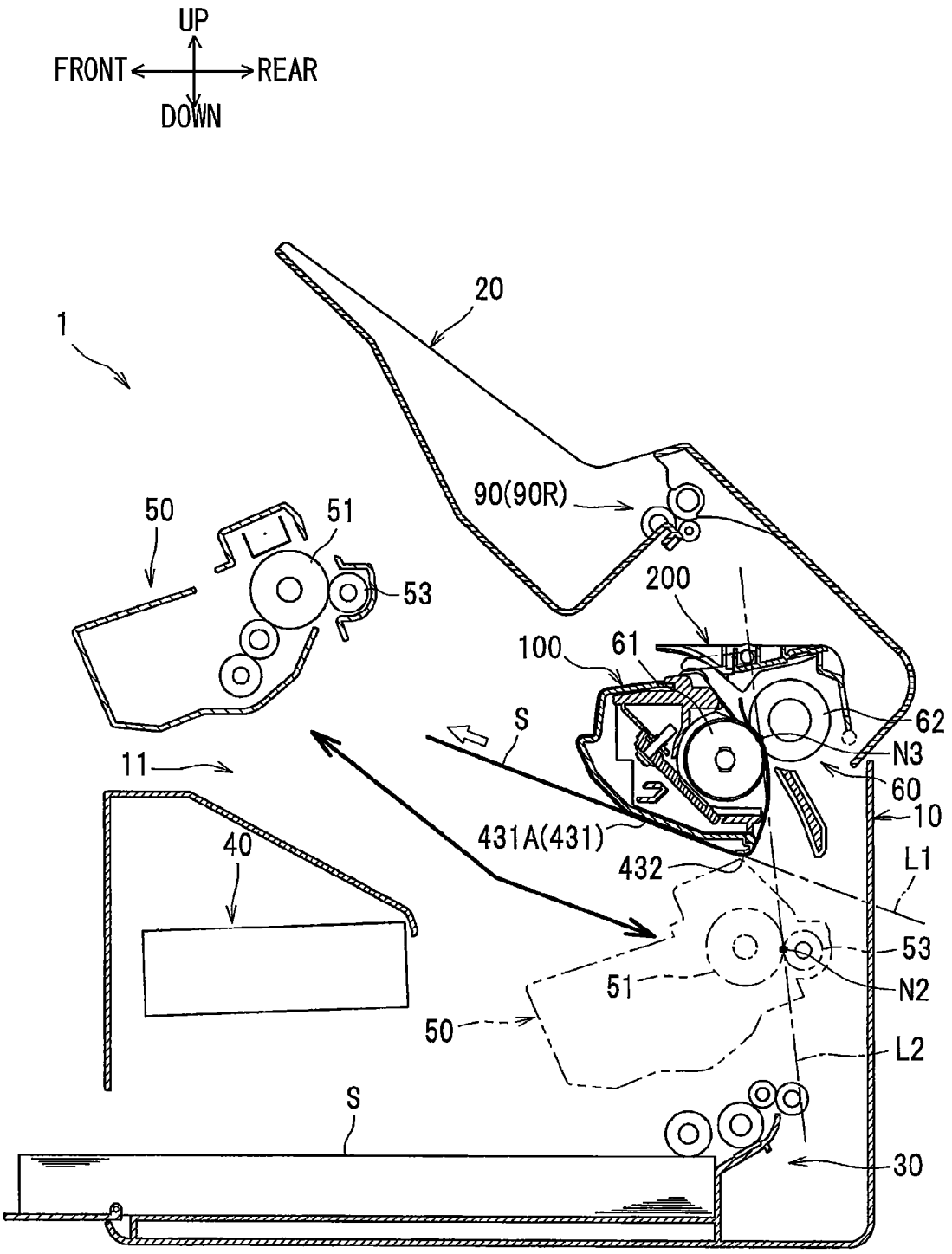
FIG. 2 is a cross-sectional side view of the image forming apparatus of FIG. 1 when a top cover is opened.

When the top cover 20 is rotated into the open position, the process cartridge 50 can be mounted in or removed from the main frame 10 through the access opening 11 formed in the main frame 10 (see FIG. 2). When mounted in the main frame 10, the process cartridge 50 is positioned above the rear side of the sheet-feeding unit 30. The process cartridge 50 is configured to transfer a toner image (developer image) onto a sheet S. The process cartridge 50 includes a photosensitive drum 51, a charger 52, a transfer roller 53, and a developing roller 54, as well as a thickness-regulating blade and a toner-accommodating section for accommodating toner (both not shown). In an image-forming operation, the charger 52 of the process cartridge 50 applies a uniform charge to the surface of the photosensitive drum 51. Subsequently, the exposure unit 40 irradiates a laser beam onto the surface of the photosensitive drum 51 to form an electrostatic latent image thereon based on image data. Next, the developing roller 54 supplies toner from the toner-accommodating section onto the photosensitive drum 51, developing the latent image formed on the photosensitive drum 51 into a toner image. The toner image on the photosensitive drum 51 is then transferred onto a sheet S supplied from the sheet-feeding unit 30 as the sheet S passes between the photosensitive drum 51 and transfer roller 53.

The fixing unit 60 is disposed above the process cartridge 50 mounted in the main frame 10. The fixing unit 60 is configured to thermally fix the toner image transferred onto (deposited on) the sheet S to provide an image-fixed sheet. The fixing unit 60 primarily includes a heating roller 61, and a pressure roller 62. After a toner image has been transferred onto a sheet S in an image-forming operation, the sheet S is conveyed through the fixing unit 60, at which time the toner image is thermally fixed to the sheet S as the sheet S passes between the heating roller 61 and pressure roller 62.

The sheet discharge unit 90 is provided on the top cover 20 at a position obliquely above and forward of the heating roller 61 when the top cover 20 is in the closed position. The sheet discharge unit 90 primarily includes discharge rollers 90R. The sheet discharge unit 90 is configured to discharge the image-fixed sheet out of the main frame 10. After a toner image has been thermally fixed to a sheet S, the discharge rollers 90R discharge the image-fixed sheet S from the main frame 10 onto the discharge tray 21 of the top cover 20.

Figure 3:
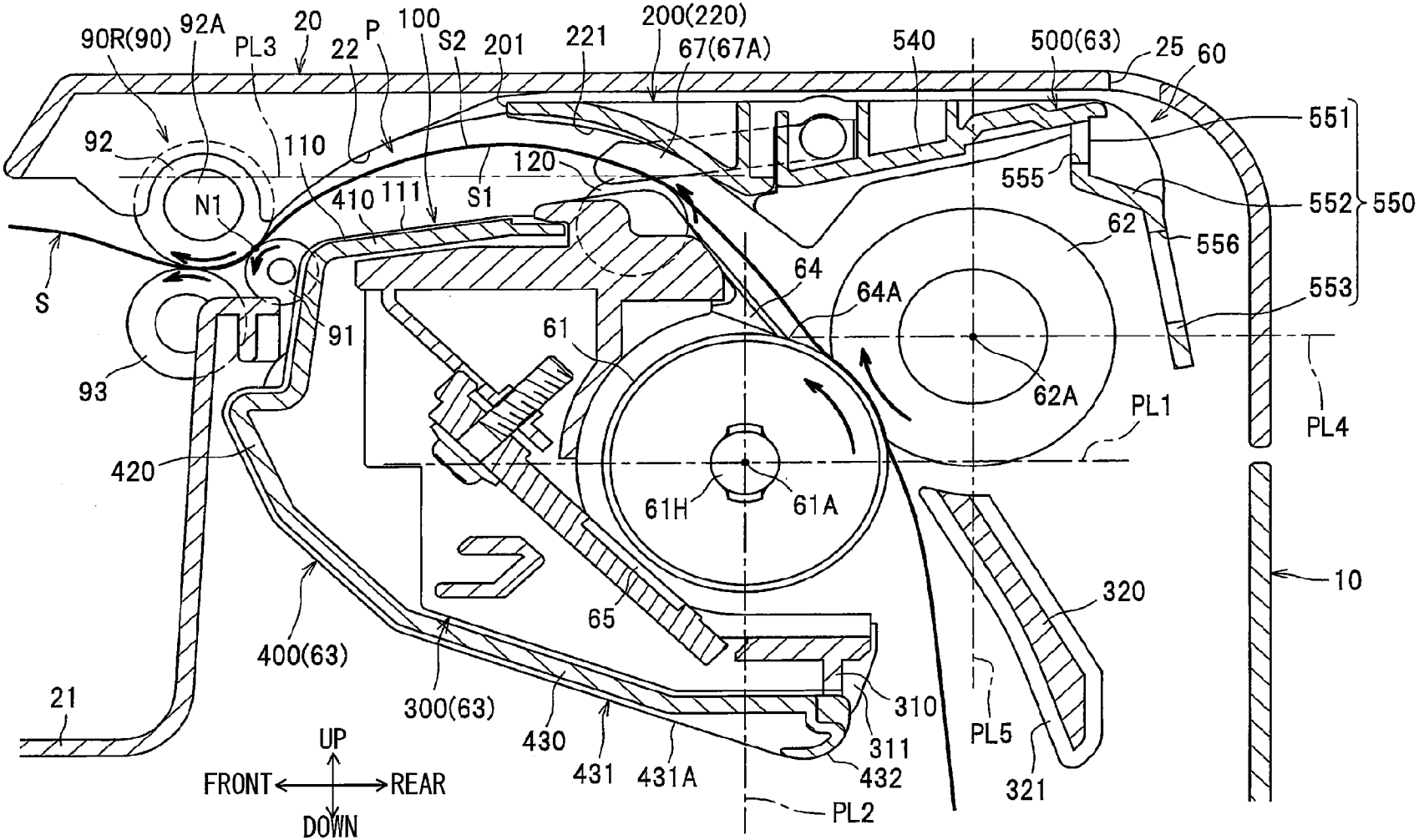
FIG. 3 is an enlarged cross-sectional side view of a fixing unit of the image forming apparatus and peripheral parts of the fixing unit.

Next, the structure of the laser printer 1 related to a feature of the present invention will be described. As shown in FIG. 3, in addition to the heating roller 61 and pressure roller 62, the fixing unit 60 includes a case 63 supporting the heating roller 61 and pressure roller 62; separating members 64 configured to separate sheets S from the heating roller 61; and a thermistor 65.

The heating roller 61 is a metal roller with a hollow center. A halogen lamp 61H is disposed in the hollow center of the heating roller 61. As a sheet S passes between the heating roller 61 and pressure roller 62, heat generated by the halogen lamp 61H is transmitted to the sheet S to heat the toner thereon. The pressure roller 62 is configured of a metal core surrounded by an elastic layer. The pressure roller 62 is disposed diagonally above and rearward of the heating roller 61. One of the heating roller 61 and pressure roller 62 is driven to rotate by a drive force transmitted from a motor (not shown), while the other follows the rotation of the first owing to the frictional force generated therebetween. Consequently, a sheet S interposed between the heating roller 61 and pressure roller 62 is conveyed downstream.

Figure 4:
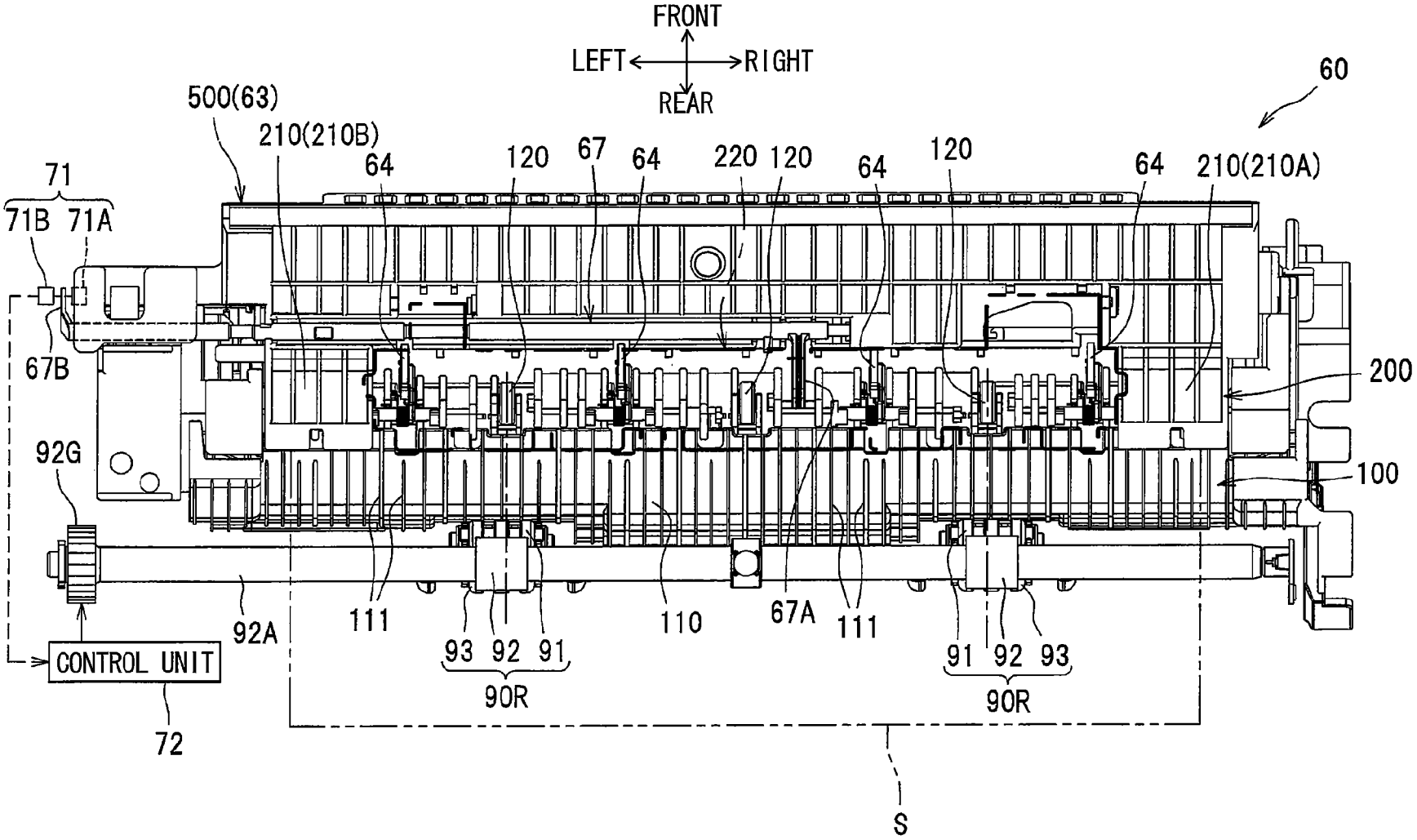
FIG. 4 is a plane view of the fixing unit.

As shown in FIG. 4, four separating members 64 are arranged (juxtaposed) at intervals in the left-right direction, i.e., along the widthwise direction of a sheet S conveyed between the heating roller 61 and pressure roller 62. As shown in FIG. 3, each of the separating members 64 has a distal end 64A that tapers to a point. In a side cross-sectional view, the sides of the distal end 64A form an acute angle. Each of the separating members 64 is mounted on the case 63 (and specifically on a frame member 300 described later) so that its distal end 64A contacts the top circumferential surface of the heating roller 61.

The thermistor 65 shown in FIG. 3 is a non-contact temperature sensor configured to detect the temperature of the heating roller 61. An example configuration of the thermistor 65 includes a thermistor element provided on a film formed of polyimide or the like that can absorb infrared radiation. The thermistor 65 is disposed on the opposite side of the heating roller 61 from the pressure roller 62 and confronts but is separated from (spaced apart from) the peripheral surface of the heating roller 61. More specifically, when the fixing unit 60 is in an operable state, i.e., mounted in the main frame 10, the thermistor 65 is positioned below a horizontal plane PL1 that passes through the rotational center 61A of the heating roller 61 and upstream of a vertical plane PL2 passing through the rotational center 61A with respect to the rotational direction of the heating roller 61. The thermistor 65 outputs data indicating the detected temperature to a control unit 72 described later (see FIG. 4) to be used by the control unit 72 for controlling the halogen lamp 61H (fixing unit 60).

The case 63 constitutes the frame of the fixing unit 60. A conveying path P is formed in the case 63 for guiding a sheet S out of the main frame 10 after a fixing operation, and more specifically for guiding the sheet S being conveyed from the heating roller 61 and pressure roller 62 toward the sheet discharge unit 90. This configuration eliminates at least a part of the conveying path that should be formed in the main frame 10, thereby reducing the cost of manufacturing the laser printer 1.

The conveying path P is defined by the top cover 20, a first conveying guide 100, and a second conveying guide 200. The first conveying guide 100 defines a lower portion of the conveying path and is configured to guide a front surface S1 of the image-fixed sheet S on which the toner image is transferred. The second conveying guide 200 defines the upper portion of the conveying path P and is configured to guide a back surface S2 of the image-fixed sheet S on the opposite side of the front surface S1.

A plurality of guide ribs 22, 111, and 211 and 221 are provided on the surfaces of the top cover 20, first conveying guide 100, and second conveying guide 200 that define the part of the conveying path P, respectively. The guide ribs 22, 111, 211, and 221 are arranged at intervals in the left-right direction and extend along the conveying direction of the sheet S. The guide ribs 22, 111, 211, and 221 protrude into the conveying path P. In the following description, the direction in which the sheets S are conveyed will be simply called the "conveying direction." In other words, the conveying direction is course along which the image-fixed sheet S moves from the heating roller 61 to the sheet discharge unit 90.

Specifically, the first conveying guide 100 extends a position above the heating roller 61 toward sheet discharge unit 90. The first conveying guide 100 has a guide surface 110 on which the guide ribs 111 are provided. The guide surface 110 extends in substantially the front-rear direction from a position above the heating roller 61 toward the sheet discharge unit 90 and sloping downward toward the downstream side of the conveying direction. Guide rollers 120 are provided on the upstream end portion of the first conveying guide 100 with respect to the conveying direction.

The guide rollers 120 are disposed so that the sheets S pass over the tops thereof and are configured to rotate along with the movement of the conveyed sheet S due to the frictional force generated between the sheet S and the guide rollers 120. That is, the guide rollers 120 are configured to rotate when further conveying the image-fixed sheet S has been conveyed from the fixing unit 60. In this embodiment, three guide rollers 120 are arranged at intervals in the left-right direction, with one positioned between each pair of adjacent separating members 64, as shown in FIG. 4. The guide rollers 120 provided in the laser printer 1 can facilitate conveyance of sheets S within the conveying path P. That is, the guide rollers 120 reduce the amount of friction applied to the front surface S1 by rotating along with the conveyance of the sheet S.

Next, the positional relationships of the guide rollers 120 and discharge rollers 90R will be described. As shown in FIG. 3, two sets of discharge rollers 90R are provided at positions separated in the left-right direction. Each set of discharge rollers 90R includes a first discharge roller 91, a second discharge roller 92 disposed obliquely above and forward of the first discharge roller 91, and a third discharge roller 93 disposed downstream of the first discharge roller 91 in the conveying direction. A rotational shaft 92A passes through the second discharge rollers 92. A gear 92G (see FIG. 4) is provided on one end of the rotational shaft 92A for transmitting a drive force to the rotational shaft 92A. The drive force transmitted to the rotational shaft 92A conveys a sheet S interposed between the first discharge roller 91 and second discharge roller 92 and between the second discharge roller 92 and third discharge roller 93.

The first discharge roller 91 and second discharge roller 92 are arranged such that their nip position N1 is below a horizontal plane PL3 tangent to the top of the guide rollers 120. This configuration is conducive to reducing the vertical dimension of the laser printer 1 compared to a structure in which the nip position N1 is above the horizontal plane PL3.

Further, by arranging the first discharge roller 91 and second discharge roller 92 so that their nip position N1 is below the horizontal plane PL3, a sheet S is guided obliquely downward from the guide rollers 120 toward the nip position N1 and the sheet S continues to be conveyed obliquely downward from the nip position N1 between the first discharge roller 91 and second discharge roller 92. However, after the sheet S passes between the first discharge rollers 91 and second discharge rollers 92 in the embodiment, the third discharge rollers 93 discharge the sheet S in a direction angled upward from the angle of insertion at the nip position N1. This configuration enables a larger number of sheets S to be discharged and stacked on the discharge tray 21 than if the sheets S were discharged in a downward direction. Further, configuring the discharge rollers 90R of three rollers restrains the sheets S from curling in a direction that could bring the leading edge of a discharged sheet S closer to the trailing edge of a previously discharged sheet S.

As shown in FIG. 4, a plurality of sets (and specifically two sets) of the discharge rollers 90R is arranged at intervals in the left-right direction, similar to the guide rollers 120. Providing the guide rollers 120 and the sets of discharge rollers 90R at intervals in this way, rather than long rollers that extend in the widthwise direction, can help reduce the manufacturing costs of the laser printer 1.

The rightmost guide roller 120 and the right set of discharge rollers 90R (first discharge roller 91 and second discharge roller 92) are disposed in the same position in the left-right direction (widthwise direction of the sheet), while the leftmost guide roller 120 and the left set of discharge rollers 90R are disposed in the same position in the left-right direction. This arrangement allows the guide rollers 120 positioned upstream from the discharge rollers 90R in the conveying direction to operate effectively so that the sheets S are conveyed more smoothly with less friction applied to the front surface S1.

As shown in FIG. 3, the second conveying guide 200 is disposed above the heating roller 61 and opposes and faces the upstream portion of the first conveying guide 100 possessing the guide roller 120. The second conveying guide 200 extends toward the sheet discharge unit 90 from a position above the heating roller 61. The downstream end of the second conveying guide 200 in the conveying direction will be called a downstream end 201. The downstream end 201 of the second conveying guide 200 is separated a prescribed distance in the front-rear direction from the second discharge roller 92 of the sheet discharge unit 90. The downstream end 201 and the sheet discharge unit 90 define a space therebetween. Thus, the second conveying guide 200 defines the rear portion on the upper side of the conveying path P.

The top cover 20 on the other hand forms the front portion on the upper side of the conveying path P. When the top cover 20 is in the closed position, the guide ribs 22 provided on the top cover 20 are positioned between the downstream end 201 of the second conveying guide 200 and the second discharge rollers 92. The guide ribs 22 contact the back surface S2 of a sheet S conveyed out from (passing) between the first conveying guide 100 and second conveying guide 200 to guide the sheet S toward the sheet discharge unit 90, and specifically toward the nip position N1. Providing both the sheet discharge unit 90 and guide ribs 22 on the top cover 20 improves the precision in positioning the sheet discharge unit 90 and guide ribs 22 relative to each other so that the guide ribs 22 can better guide sheets S toward the nip position N1.

When in the closed position shown in FIGS. 1 and 3, the top cover 20 covers the second conveying guide 200 and the space between the downstream end 201 of the second conveying guide 200 and the sheet discharge unit 90. When the top cover 20 is in the open position shown in FIGS. 2 and 14, the second conveying guide 200 and the space between the downstream end 201 of the second conveying guide 200 and discharge unit 90 are exposed. Thus, by rotating the top cover 20 into the open position, the operator can expose the portion of the conveying path P between the downstream end 201 of the second conveying guide 200 and discharge unit 90, as well as the second conveying guide 200, in order to operate a movable guide part 220 (movable guide) described later.

As shown in FIG. 4, the second conveying guide 200 has fixed guide parts 210 for guiding the left and right ends of a sheet S, indicated by a double chain line in FIG. 4, by contacting the back surface S2 of the sheet S; and the movable guide part 220 indicated by a bold double chain line in FIG. 4 that is positioned between the fixed guide parts 210 with respect to the left-right direction. More specifically, the fixed guide parts 210 of the second conveying guide 200 are a first fixed guide part 210A for guiding one left-right end of the sheet S (the right end in FIG. 4) on the back surface S2 side, and a second fixed guide part 210B for guiding the other end (the left end in FIG. 4). The movable guide part 220 is positioned between the first and second fixed guide parts 210A and 210B so as to be adjacent to both.

Figure 5A:
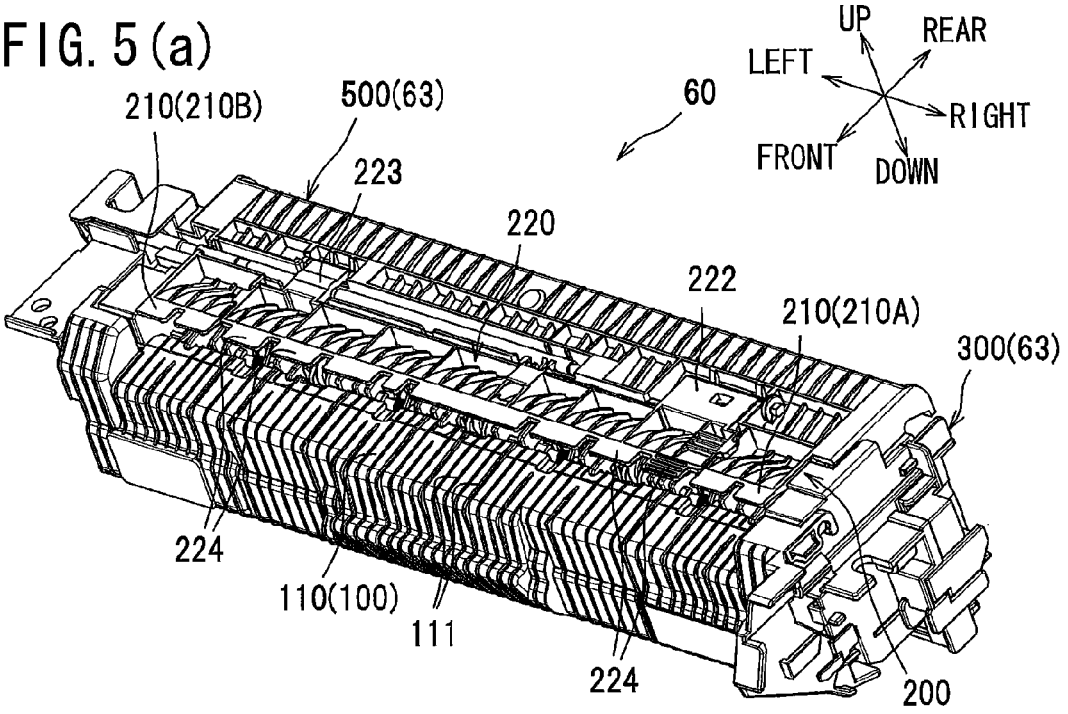
FIG. 5(*a*) is a perspective view of the fixing unit when a movable guide part of the fixing unit is in a first position.
Figure 5B:
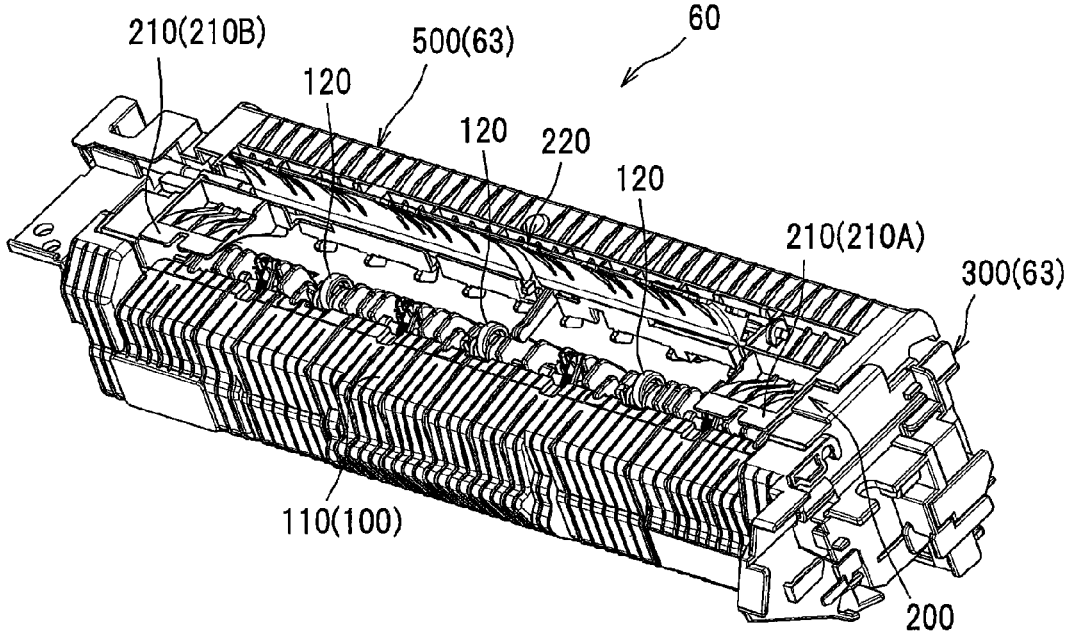
Figure 8A:
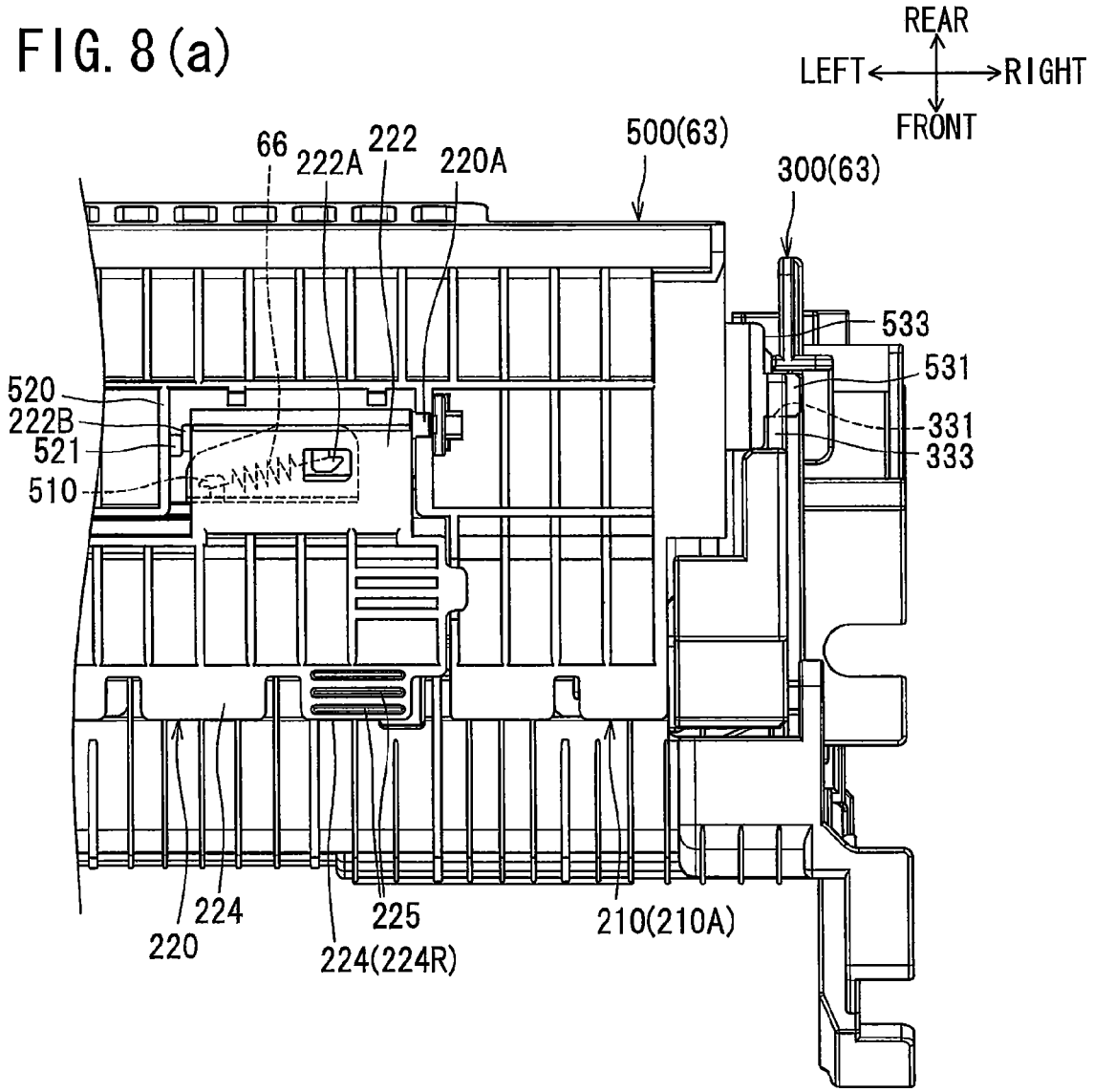
FIG. 8(*a*) is an enlarged partial plane view of the fixing unit when the movable guide part if in the first position.
Figure 8B:
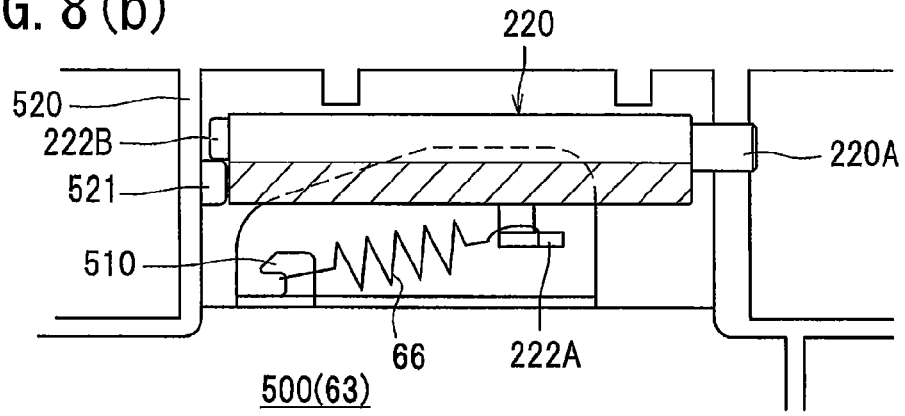

As shown in FIGS. 5(*a*) and 5(*b*), the fixed guide parts 210 are incapable of moving relative to the case 63 (the frame member 300) fixed to the main frame 10. However, the movable guide part 220 is capable of rotating about rotational shafts 220A (only one is shown in FIG. 8). More specifically, the movable guide part 220 has expanded parts 222 and 223 that extend rearward. The expanded parts 222 and 223 are provided in two locations on the movable guide part 220. The rotational shafts 220A are provided on the respective outer left-right sides of the expanded parts 222 and 223 near the rear ends thereof. The movable guide part 220 can rotate about the rotational shafts 220A relative to the case 63 (frame member 300) and the fixed guide parts 210.

Through this structure, the movable guide part 220 is movable (pivotable) relative to the main frame 10 between a first position shown in FIGS. 3 and 5(*a*) confronting and facing the first conveying guide 100 for guiding sheets S, and a second position shown in FIGS. 5(*b*) and 14 for opening and exposing the section of the conveying path P upstream of the first conveying guide 100 with respect to the conveying direction. As described above, the fixed guide parts 210 are fixed in position and do not move relative to the main frame 10.

Figure 6:
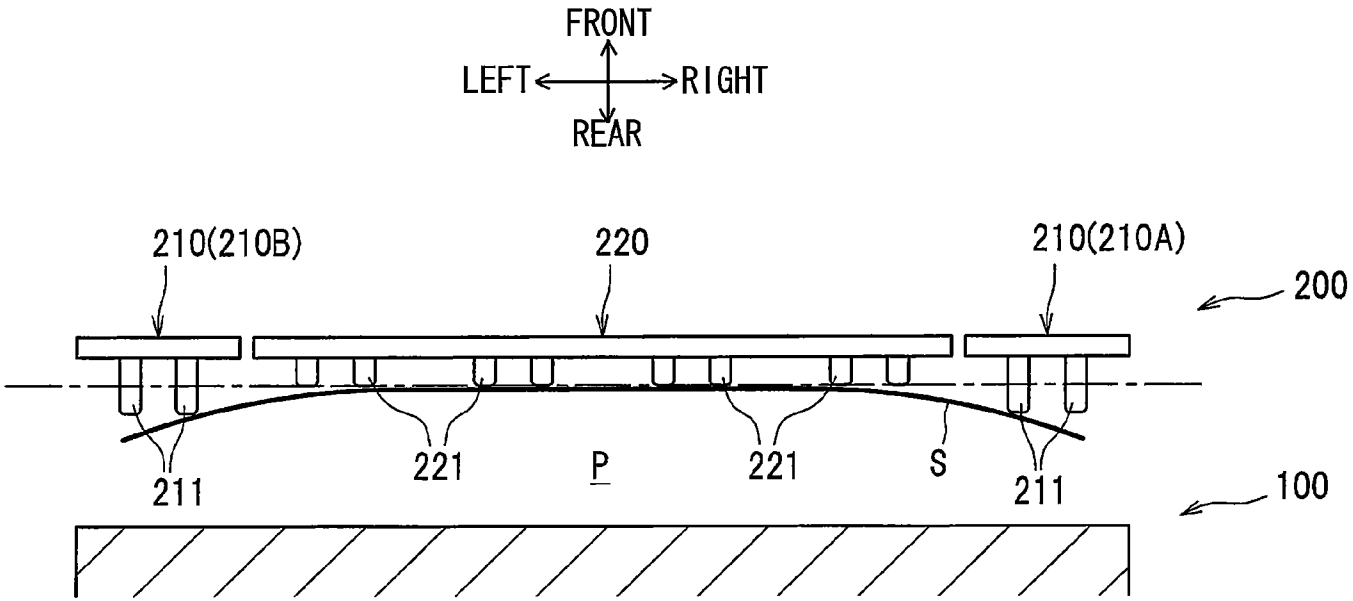
FIG. 6 is an explanatory diagram showing guide ribs provided on the fixing unit.

As shown in FIG. 6, the guide ribs 211 are provided on the fixed guide parts 210 and the guide ribs 221 are provided on the movable guide part 220. When the movable guide part 220 is in the first position, the guide ribs 211 protrude further into the conveying path P than the guide ribs 221 to guide the sheet S. This configuration can convey sheets S with a left-right cross-sectional shape shown in FIG. 6, restraining the left and right ends of the sheets S from curling upward.

Figure 7:
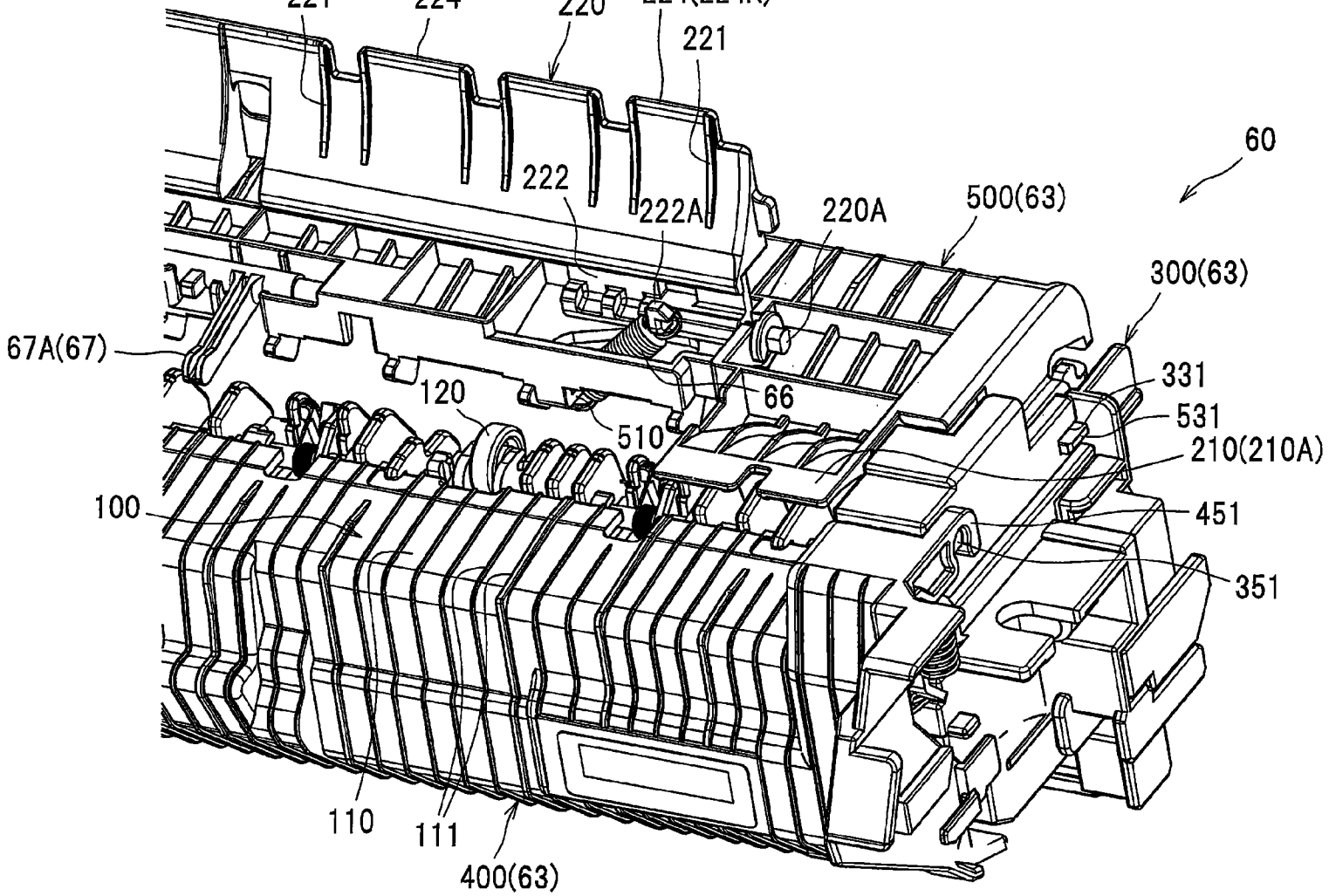
FIG. 7 is an enlarged perspective view of the fixing unit when the movable guide part is in the second position.

As shown in FIG. 7, a coil spring 66 is provided for constantly urging the movable guide part 220 toward the first position. Thus, the coil spring 66 maintains the movable guide part 220 in the first position shown in FIG. 5(*a*) when the top cover 20 is rotated from the closed position to the open position. However, once the movable guide part 220 is rotated from the first position to the second position shown in FIG. 5(*b*), the movable guide part 220 is held in the second position by a retaining part 521 described later, as is illustrated in FIGS. 8 and 9.

Figure 9A:
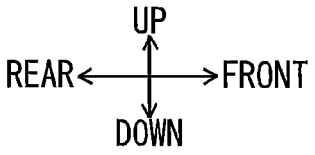
FIG. 9(*a*) is an explanatory diagram showing the movable guide part and a retaining part when the movable guide part is in the first position.
Figure 9A:
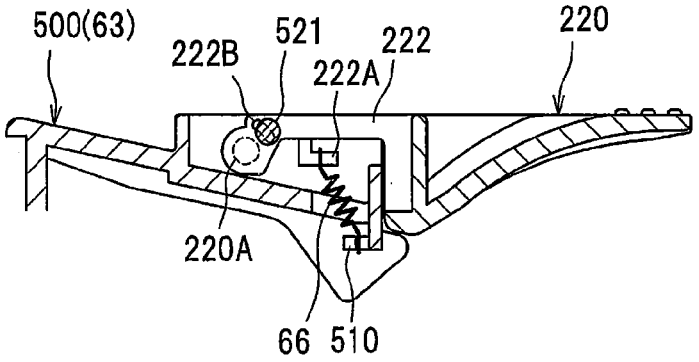
Figure 9B:
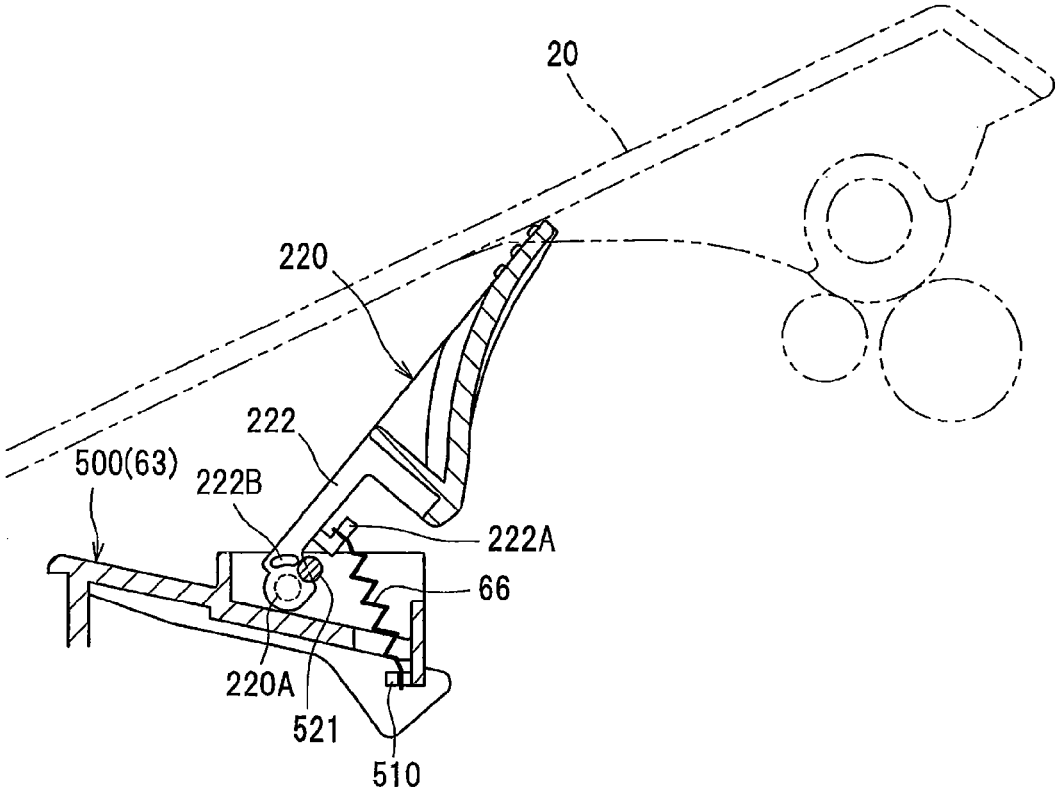

As shown in FIGS. 7 and 9, the top end of the coil spring 66 is anchored to a hook-like anchoring part 222A formed near the center of the expanded part 222, and the bottom end of the coil spring 66 is anchored to a hook-like anchoring part 510 formed on the front wall of the case 63 (and specifically a roof member 500 described later) at a position lower than the anchoring part 222A so that the coil spring 66 is slightly stretched. Since the coil spring 66 is in a stretched state, the restoring force of the coil spring 66 urges the movable guide part 220 toward the first position. Note that the anchoring part 510 is positioned further leftward than the anchoring part 222A in the preferred embodiment. Accordingly, it is more accurate to say that the coil spring 66 urges the movable guide part 220 diagonally downward and leftward.

As shown in FIGS. 8(*a*) through 9, the case 63 (the roof member 500 has a rib 520 (FIGS. 8(*a*) and 8(*b*)) that opposes the left endface of the expanded part 222. The retaining part 521 is a protrusion formed on the rib 520. The retaining part 521 has a general columnar shape and protrudes rightward from the rib 520. A retained part 222B is formed on the left endface of the expanded part 222. The retained part 222B is generally arc-shaped in a side view and protrudes outward from the left endface of the expanded part 222. The movable guide part 220 is supported so as to be capable of rotating relative to the case 63 and capable of moving slightly in the left-right direction. When the movable guide part 220 is in the first position shown in FIGS. 8(*a*) and 9(*a*), the endfaces of the retained part 222B and retaining part 521 are in contact with each other. When the movable guide part 220 is in the second position shown in FIGS. 8(*b*) and 9(*b*), the urging force of the coil spring 66 forces the movable guide part 220 to slide slightly leftward so that the retained part 222B contacts the side surface of the retaining part 521 from the rear. In this state, the retaining part 521 restricts rotation of the movable guide part 220. Movement of the movable guide part 220 will be described later in greater detail.

As shown in FIG. 5(*a*), the movable guide part 220 has a plurality of plate-shaped operating parts 224 on the downstream end in the conveying direction. The operating parts 224 can be gripped in order to move (operate) the movable guide part 220. By operating the operating parts 224 in this way, the user can rotate the movable guide part 220 to the second position shown in FIG. 5(*b*). As shown in FIG. 8(*a*), three protrusions 225 are provided on the top surface of the operating part 224R positioned on the right end of the movable guide part 220. The protrusions 225 are juxtaposed in the front-rear direction and elongated in the left-right direction. The three protrusions 225 serve as markers to make the user aware that the movable guide part 220 is movable and to make the user aware of the existence of the operating parts 224 provided on the movable guide part 220.

Here, the positional relationships of the movable guide part 220 and the separating members 64 will be described. As shown in FIG. 4, all four separating members 64 are positioned within the left-right range of the movable guide part 220. Hence, all four separating members 64 are positioned beneath the movable guide part 220 when the movable guide part 220 is in the first position, while none of the separating members 64 is positioned beneath the fixed guide parts 210. Thus, all of the separating members 64 are exposed when the movable guide part 220 is rotated into the second position.

Figure 10A:
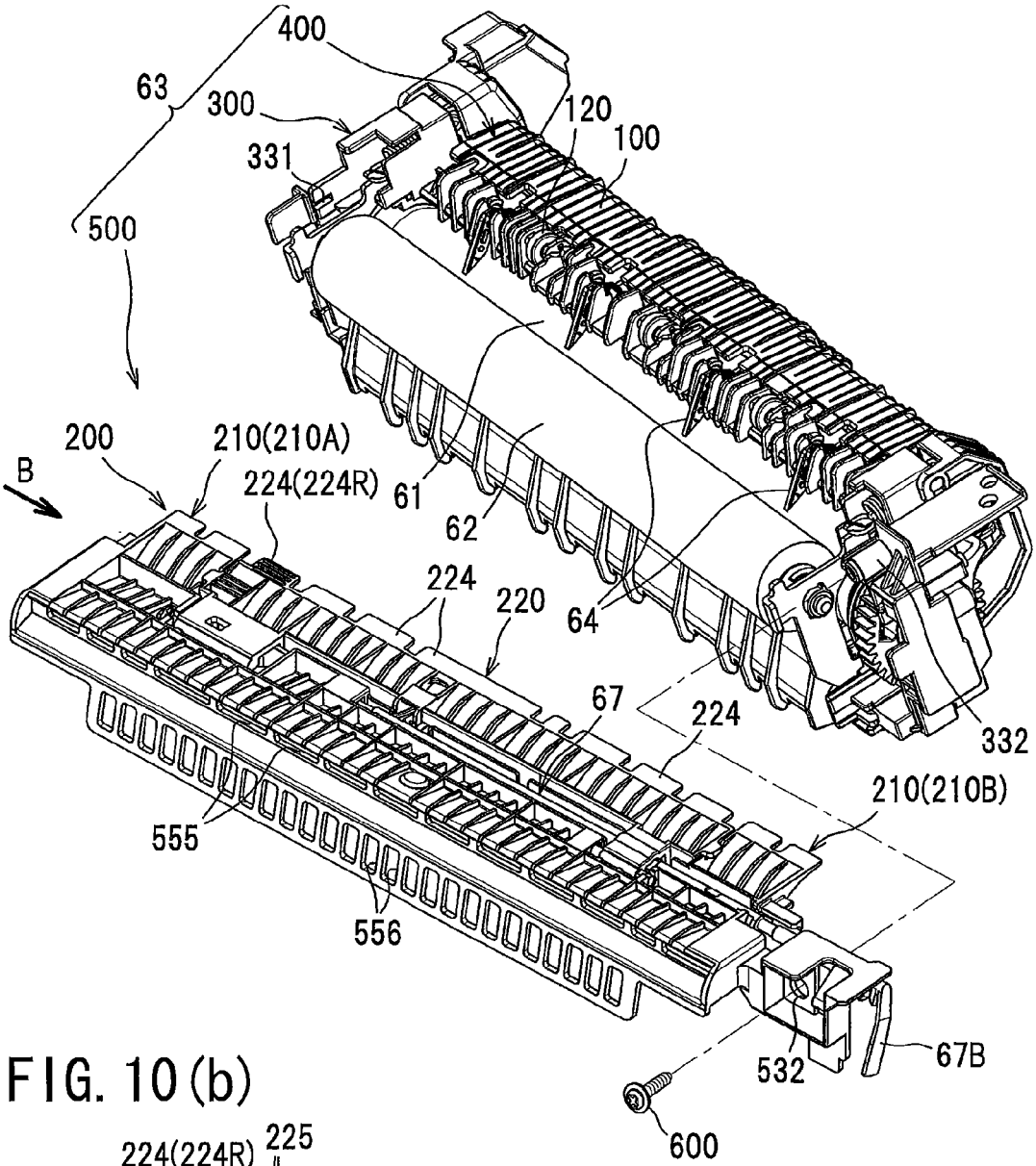
FIG. 10(*a*) is an explanatory diagram showing a roof member and a frame member to which a cover is attached in the fixing unit.
Figure 10B:
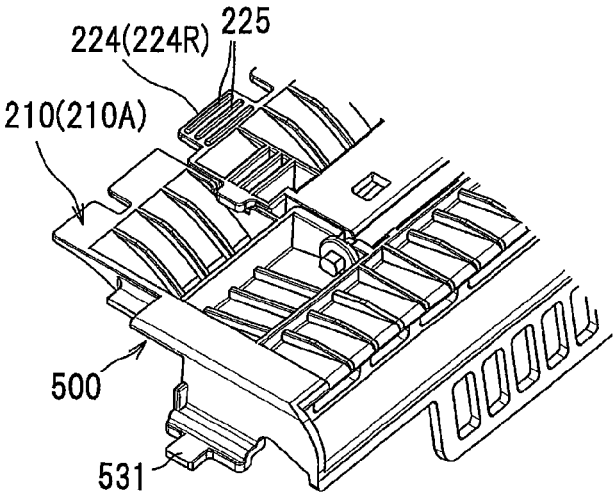

Next, the structures of the components constituting the case 63 of the fixing unit 60 will be described. As shown in FIG. 10(*a*), the case 63 primarily includes the frame member 300 configured to rotatably support the heating roller 61 and pressure roller 62, a cover 400 formed separately from the frame member 300, and the roof member 500 mentioned above. As will be described later in greater detail, the cover 400 and roof member 500 are detachably mounted on the frame member 300.

With the second conveying guide 200 provided on the roof member 500, the roof member 500 covers the tops of the heating roller 61 and pressure roller 62 when mounted on the frame member 300. The roof member 500 includes an engaging piece 531 formed on the right end thereof, as viewed in a direction indicated by the arrow B in FIG. 10(*a*), and a through-hole 532 formed in the left end thereof. The engaging piece 531 extends outward (rightward) from the right end of the roof member 500, as shown in FIG. 10(*b*). The through-hole 532 penetrates the left end of the roof member 500 in the front-rear direction.

As shown in FIG. 3, the roof member 500 also includes a sloped wall 540 that extends diagonally upward and rearward from a position above the heating roller 61 in a direction away from the second conveying guide 200, and a rear wall 550 that extends downward from the sloped wall 540 at a position near the highest end. The rear wall 550 has a top wall part 551 extending downward from a point near the top end of the sloped wall 540, a connecting part 552 extending substantially rearward from the bottom end of the top wall part 551, and a bottom wall part 553 extending downward from the rear end of the connecting part 552. Hence, the bottom wall part 553 is offset from the top wall part 551 in the front-rear direction.

Pluralities of through-holes 555 and 556 are formed in the rear wall 550 at intervals in the left-right direction to provide communication between the interior and exterior of the case 63 (see FIG. 10(*a*)). More specifically, the through-holes 555 are provided in the top wall part 551 near the upper end of the sloped wall 540, while the through-holes 556 are formed in the bottom wall part 553. Further, the through-holes 555 and 556 are provided above a horizontal plane PL4 passing through a rotational center 62A of the pressure roller 62 and downstream with respect to a vertical plane PL5 passing through the rotational center 62A in the rotating direction of the pressure roller 62. In the embodiment, through-holes 25 are also formed in the top wall of the top cover 20 near the rear end thereof at positions confronting the connecting part 552 of the rear wall 550. The through-holes 25 provide communication between the interior and exterior of the top cover 20.

With the above structure, heat emitted from the heating roller 61, and more accurately hot air produced from heat generated by the heating roller 61, moves diagonally upward and rearward along the bottom surface of the sloped wall 540 and is exhausted from the case 63 through the through-holes 555 and 556. The hot air is further discharged outside of the top cover 20 (i.e., from the laser printer 1) through the through-holes 25. Configuring the laser printer 1 with the heat exhaustion structure described above eliminates the need to provide a fan in the laser printer 1 for discharging air from the device, thereby making it possible to reduce manufacturing costs of the laser printer 1.

As described above, the separating members 64 and thermistor 65 are mounted in the frame member 300 in an area upstream in the conveying direction from the first conveying guide 100, which includes the guide roller 120. Further, a pair of guide walls 310 and 320 is formed on the bottom portion of the frame member 300. The guide walls 310 and 320 oppose each other in the front-rear direction. A sheet S conveyed out of the process cartridge 50 passes between the guide walls 310 and 320. Pre-fixing guides 311 and 321 are respectively provided on the surfaces of the guide walls 310 and 320 that oppose the sheet S conveyed therebetween for guiding the sheet S toward the nip part between the heating roller 61 and pressure roller 62. More specifically, the pre-fixing guides 311 and 321 are configured as ribs extending in the conveying direction and spaced at intervals in the left-right direction (see FIG. 11). The pre-fixing guides 311 and 321 protrude toward the sheet S.

The cover 400 includes a top wall 410, a front wall 420, and a bottom wall 430. When mounted on the frame member 300, the cover 400 is configured to cover at least a portion of the frame member 300 including the front portion on the top of the frame member 300, the front of the frame member 300, and the bottom of the frame member 300. The first conveying guide 100 is integrally formed on the top wall 410 of the cover 400 and is configured to guide a sheet S out of the main frame 10 by the front surface S1 after a fixing operation. This configuration not only reduces the number of required parts, but also enables the first conveying guide 100 to be mounted in the main frame 10 at the same time the fixing unit 60 is mounted in the main frame 10, thereby reducing the number of steps required to manufacture the laser printer 1.

When the cover 400 is mounted on the frame member 300, the front wall 420 and bottom wall 430 cover the thermistor 65. In this way, the thermistor 65 is disposed between the frame member 300 and cover 400. By disposing the thermistor 65 in this way, the cover 400 can protect the thermistor 65 from impacts and the like occurring when the fixing unit 60 is mounted in the main frame 10.

Further, since the thermistor 65 is a non-contact temperature sensor, covering the thermistor 65 with the cover 400 reduces the effects of external air, airflows, and the like on the thermistor 65, thereby improving the precision in which the thermistor 65 detects the temperature of the heating roller 61. Further, since heat emitted from the heating roller 61 rises due to convection, providing the thermistor 65 obliquely below and forward of the heating roller 61, as in the preferred embodiment, reduces the effects of such heat on the thermistor 65, thereby improving the detection precision of the same. Further, since heat generated by the heating roller 61 escapes externally through the through-holes 25, 555, and 556 rather than becoming trapped around the heating roller 61, this configuration reduces the effects of heat around the heating roller 61 on the thermistor 65, thereby further improving the detection precision of the thermistor 65.

The bottom wall 430 is positioned between the thermistor 65 and process cartridge 50 so as to be separated from the heating roller 61 and process cartridge 50 (see FIG. 1). This configuration suppresses heat transfer to the process cartridge 50, thereby reducing the effects of such heat on the same.

Figure 11:
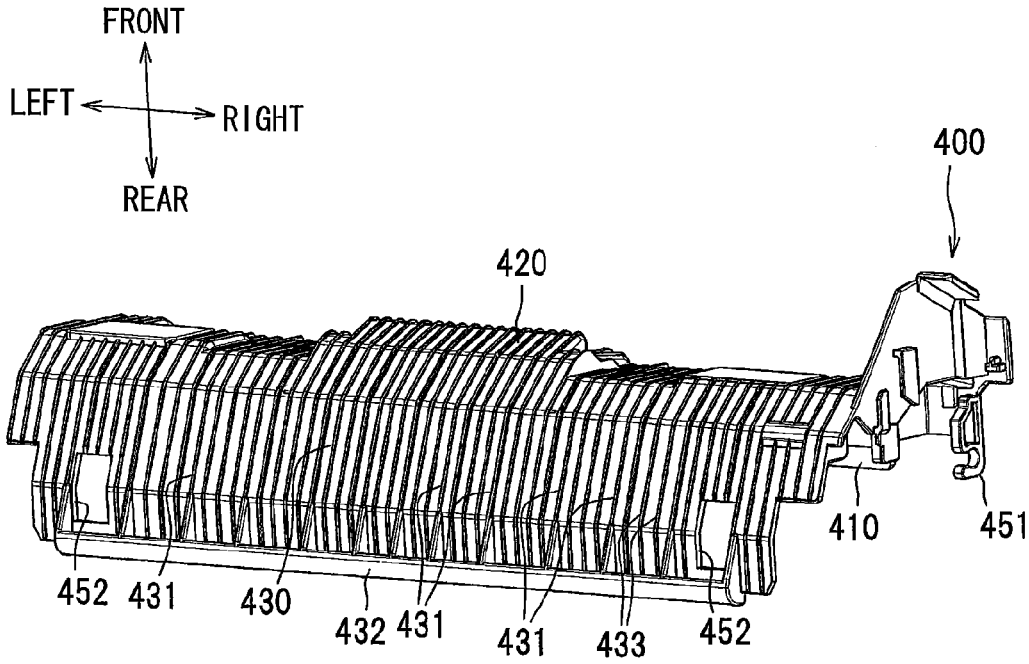
FIG. 11(*a*) is a bottom perspective view of the cover member.
Figure 11:
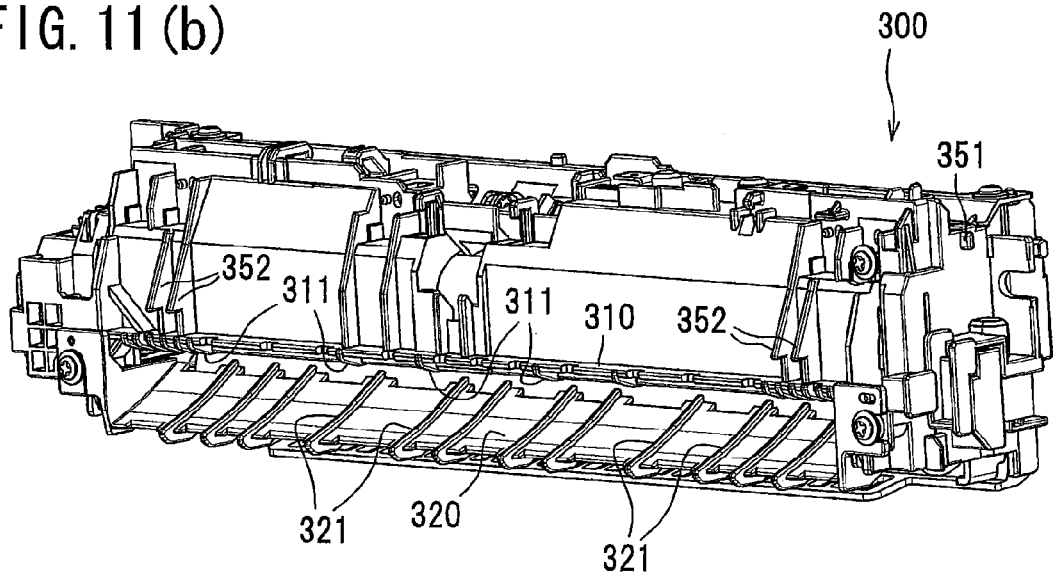

As shown in FIGS. 3 and 11, a plurality of mounting guide ribs 431 is provided on the bottom surface of the bottom wall 430 that faces the process cartridge 50. The mounting guide ribs 431 are juxtaposed in the left-right direction, extend in substantially along the front-rear direction, and protrude downward from the bottom surface of the bottom wall 430. The mounting guide ribs 431 serve to guide the process cartridge 50 when the process cartridge 50 is mounted in the laser printer 1. As shown in FIG. 2, the mounting guide ribs 431 collectively have a guide surface 431A that extends substantially in the mounting direction in which the process cartridge 50 is mounted to the main frame 10, indicated by a straight line L1. The guide surface 431A leads to the position between the fixing unit 60 and the process cartridge 50 when the process cartridge 50 is mounted in the main frame 10 (indicated by a double chain line in FIG. 2). The mounting guide ribs 431 are sloped toward the fixing unit 60 relative to a straight line L2 connecting a nip position N2 between the photosensitive drum 51 and transfer roller 53, where toner images are transferred in the process cartridge 50, and a nip position N3 between the heating roller 61 and pressure roller 62. In other words, the mounting guide ribs 431 (the line L1) form a sharp angle with the line L2.

As shown in FIG. 11, the downstream ends of the mounting guide ribs 431 with respect to the mounting direction of the process cartridge 50 are coupled together with a coupling part 432. The coupling part 432 extends across all mounting guide ribs 431 in the left-right direction. As shown in FIG. 3, the coupling part 432 is curved such that its cross section is substantially arc-shaped.

In the embodiment, a plurality of auxiliary ribs 433 (see FIG. 11) is formed between adjacent mounting guide ribs 431. The auxiliary ribs 433 extend over the front wall 420 and are coupled with the guide ribs 111 formed on the top wall 410. Thus, the auxiliary ribs 433 form single continuous ribs with the guide ribs 111.

The front wall 420 is configured to contact the top cover 20 over the left-right dimension thereof in multiple locations when the top cover 20 is closed, as shown in FIG. 3. In other words, the top cover 20 has a contact portion configured to contact the cover 400 when the top cover 20 is disposed in the closed position, the contact portion extending in the widthwise direction of sheet S. This structure reduces the flow of external air into the laser printer 1 between the cover 400 and top cover 20, thereby mitigating fluctuations in the temperature of the cover 400 caused by air flowing over the cover 400. Consequently, this construction can suppress the effects of temperature changes in the cover 400 on the thermistor 65, improving the precision of the thermistor 65 for detecting the temperature of the heating roller 61.

Next, the assembly of the fixing unit 60, and primarily the case 63, will be described. As shown in FIG. 11, support shaft parts 351 (only one is shown in FIG. 11) are formed one on each of the left and right side walls of the frame member 300 and protrude outward therefrom. Anchoring pawls 352 are formed on the front side of the guide wall 310, with two formed on each of the left and right ends. The anchoring pawls 352 protrude downward. Engaging parts 451 (only one is shown in FIG. 11) are formed one on each of the left and right sides of the top wall 410 for engaging with the support shaft parts 351. Anchoring holes 452 are formed in the bottom wall 430, with one on each of the left and right ends thereof.

Figure 12:
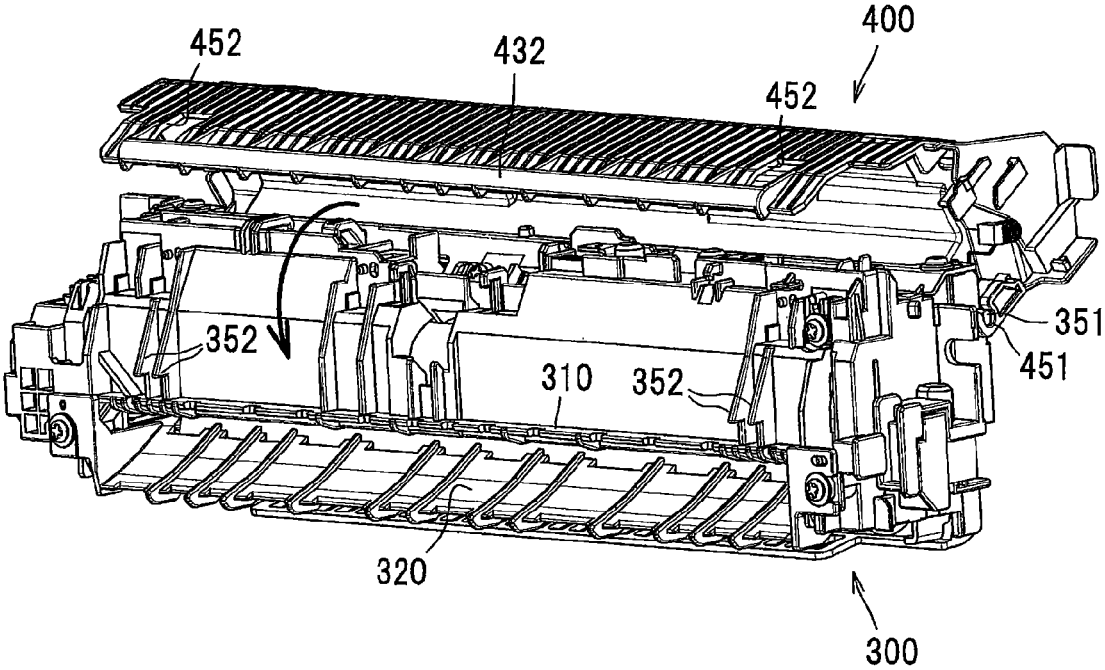
FIG. 12 is an explanatory diagram showing how to attach the cover member to the frame member.
Figure 13:
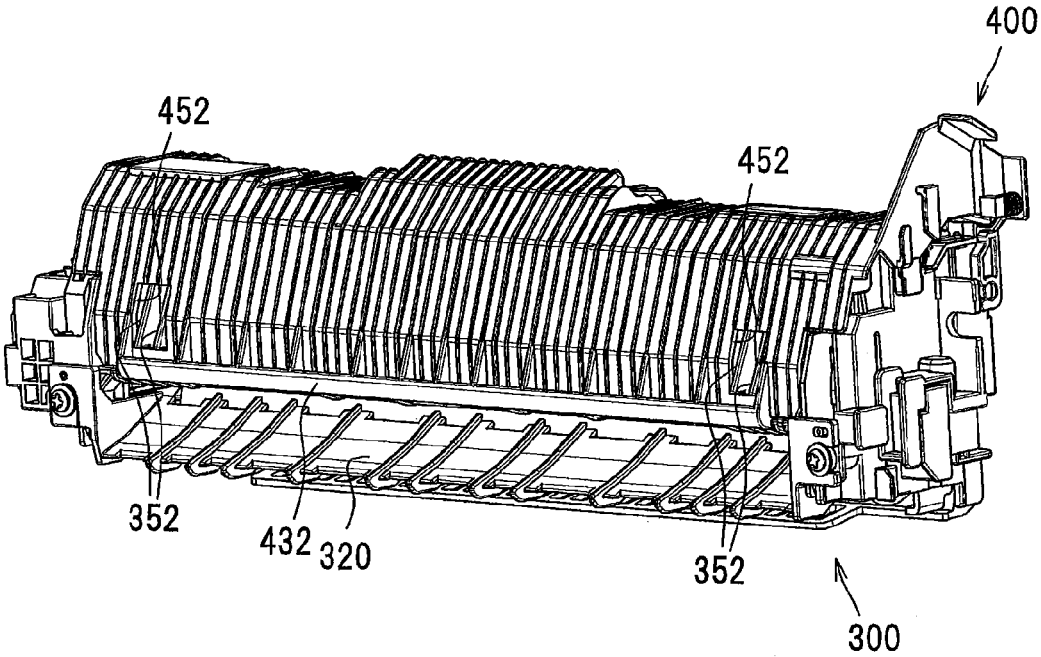
FIG. 13 is a perspective view of the frame member to which the cover member is attached.

To assemble the fixing unit 60, first the heating roller 61, thermistor 65, and other components are assembled in the frame member 300. Next, the support shaft parts 351 of the frame member 300 are engaged in the corresponding engaging parts 451 on the cover 400, as shown in FIG. 12. In this state, the cover 400 is rotated about the support shaft parts 351 in a direction for bringing the coupling part 432 side of the cover 400 toward the guide wall 320, indicated by the arrow in FIG. 12. The cover 400 is rotated until the anchoring pawls 352 are engaged in the corresponding anchoring holes 452, as shown in FIG. 13, completing assembly of the cover 400 on the frame member 300. Since the cover 400 is detachably mounted on the frame member 300 in the preferred embodiment, the cover 400 can be assembled on the frame member 300 after first assembling the thermistor 65 in the frame member 300, thereby facilitating the process for covering the thermistor 65 with the cover 400.

Next, as shown in FIGS. 10(*a*) and 10(*b*), the engaging piece 531 on the roof member 500 is engaged by being inserted into a hole 331 formed in the one side (the right side in the embodiment) of the frame member 300, and the roof member 500 is rotated about this end until the through-hole 532 engages with an end of a cylindrical fixing part 332 formed on the other side of the frame member 300. Subsequently, a screw 600 is inserted through the through-hole 532 and screwed into a hole formed in the end of the fixing part 332. This action fixes the roof member 500 to the frame member 300, completing assembly of the roof member 500 on the frame member 300 and completing assembly of the fixing unit 60 (case 63). Since only one end (left end) of the roof member 500 is fastened to the frame member 300 in the embodiment, the process of assembling the roof member 500 is simpler than when both ends are fastened.

As shown in FIG. 8(*a*), the engagement of the engaging piece 531 in the hole 331 has play in the left-right direction, enabling a gap to be formed between a right end 533 of the roof member 500 and a side wall 333 in which the hole 331 is formed. This construction provides tolerance for fluctuations in the left-right dimension of the roof member 500 caused by thermal expansion.

Next, the configuration for detecting the presence of a sheet S on the conveying path P will be described. As shown in FIG. 4, the laser printer 1 is further configured of an actuator 67, a photosensor 71, and a control unit 72.

The actuator 67 has a contact part 67A (see FIG. 7) disposed inside the conveying path P at a position for contacting a sheet S conveyed along the conveying path P, and a light-shielding part 67B provided on the opposite end from the contact part 67A. The actuator 67 is supported so as to be capable of pivoting relative to the roof member 500 (case 63) when contacted by a sheet S. As shown in FIG. 3, the portion of the contact part 67A protruding into the conveying path P is positioned downstream in the conveying direction from the distal ends 64A of the separating members 64 that contact the sheets S.

As shown in FIG. 4, the photosensor 71 includes a light-emitting element 71A for emitting light, and a light-receiving element 71B for receiving light emitted from the light-emitting element 71A. The photosensor 71 is configured to detect the presence of a sheet S in the conveying path P by detecting a change in the state of light received by the light-receiving element 71B as the actuator 67 (light-shielding part 67B) pivots (i.e., a change from an OFF state, in which light is not received, to an ON state, in which light is received).

The control unit 72 controls the various components of the laser printer 1, such as the halogen lamp 61H and the motor (not shown) that supplies a conveying force to the sheet S. The control unit 72 primarily includes a CPU, a RAM, a ROM, and an input/output interface (not shown). In this embodiment, the control unit 72 halts the motor in order to halt the conveyance of sheets S when the photosensor 71 detects the presence of a sheet S in the conveying path P for a period of time longer than a prescribed period of time (for example, when the photosensor 71 remains continuously in an ON state for at least the prescribed time).

Next, the operational advantages of the laser printer 1 according to the embodiment will be described. In an image-forming operation, a sheet S interposed between the heating roller 61 and pressure roller 62 is conveyed such that its leading edge moves toward the sheet discharge unit 90, as illustrated in FIG. 3, while the back surface S2 is guided over the guide ribs 211 (see FIG. 6) and guide ribs 221 of the second conveying guide 200. By configuring the second conveying guide 200 in the embodiment such that the fixed guide parts 210 do not move, as illustrated in FIGS. 5(*a*) and 5(*b*), the second conveying guide 200 does not rattle (vibrate), even while guiding a stiff sheet S, such as a thicker sheet, enabling the laser printer 1 to convey the sheet S with stability.

A particular feature of the preferred embodiment is that the left and right edges of the sheet S are both guided by the fixed guide parts 210. Since the fixed guide parts 210 do not move, the sheet S can be conveyed more stably. Further, the guide ribs 211 of the fixed guide parts 210 protrude further than the guide ribs 221 on the movable guide part 220. Hence, the sheet S is primarily guided by the guide ribs 211, ensuring more stable conveyance. Further, providing the coil spring 66 for urging the movable guide part 220 toward the first position suppresses vibration in the movable guide part 220, allowing the sheets S to be conveyed with stability.

When a sheet S becomes jammed in the conveying path P, the photosensor 71 will detect that the sheet S is present in the conveying path P for more than the prescribed time. Accordingly, the control unit 72 stops driving the discharge rollers 90R and the like, halting conveyance of the sheet S. The laser printer 1 according to the embodiment can suspend conveyance of sheets S when a paper jam occurs, without providing a plurality of actuators and photosensors around the heating roller 61, thereby reducing the manufacturing costs of the laser printer 1.

To resolve a paper jam, the user rotates the top cover 20 into the open position shown in FIG. 2. Rotating the top cover 20 to the open position uncovers and exposes the section of the conveying path P between the downstream end 201 of the second conveying guide 200 and the discharge rollers 90R, both indicated by double chain lines. If the leading edge of the jammed sheet (not shown) is near this section of the conveying path, the user can easily remove the sheet after pivoting the movable guide part 220 upward.

Figure 14:
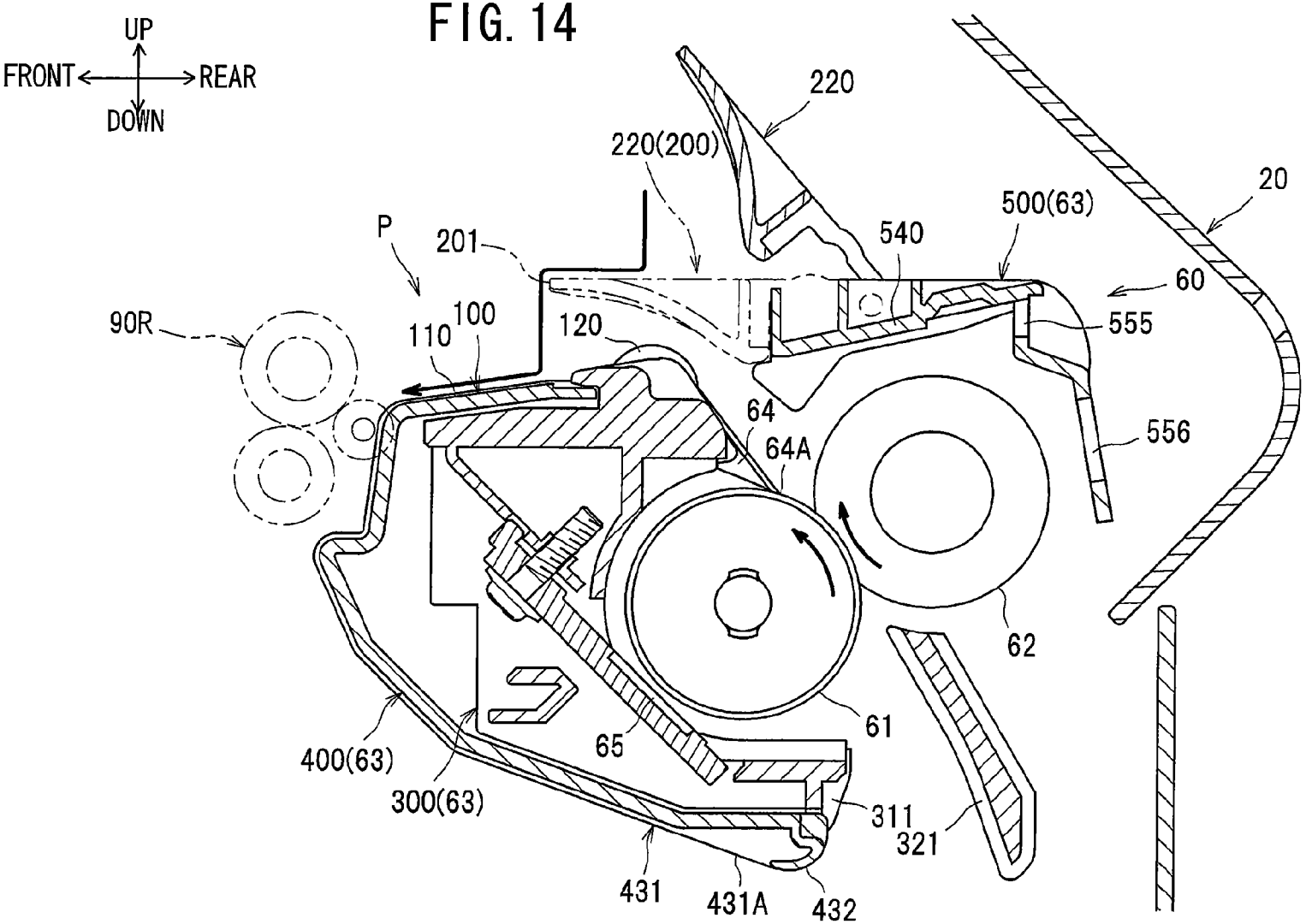
FIG. 14 is an explanatory diagram showing the peripheral of the fixing unit when the top cover is opened.

Note that when the top cover 20 is opened, the movable guide part 220 of the second conveying guide 200 disposed near the heating roller 61 is in the first position indicated by double chain lines in FIG. 14, due to the urging force of the coil spring 66. Hence, the movable guide part 220 covers the section of the conveying path P nearer to the heating roller 61 than the second conveying guide 200. With this construction, the user can remove a paper jam without directly contacting the heated area around the heating roller 61.

Further, the cover 400 on which the first conveying guide 100 is provided and the roof member 500 on which the second conveying guide 200 is provided are both formed as separate members from the frame member 300 serving to support the heating roller 61 and are detachably mounted on the frame member 300. Accordingly, this configuration can mitigate the transfer of heat from the frame member 300 to the first conveying guide 100, second conveying guide 200, and other members that the user is likely to contact when resolving a paper jam. Further, since heat emitted from the heating roller 61 is guided along the sloped wall 540 and discharged from the case 63 through the through-holes 555 and 556 as described above, this configuration reduces the amount of heat transferred to the first conveying guide 100, second conveying guide 200, and the like.

On the other hand, the user cannot remove a jammed sheet (not shown) simply by opening the top cover 20 when the leading edge of the sheet is positioned between the first conveying guide 100 and the second conveying guide 200 when the second conveying guide 200 is in the first position. However, by gripping and lifting the operating parts 224, the user can rotate the movable guide part 220 from the first position depicted with a double chain lines in FIG. 14 to the second position depicted with solid lines.

As the movable guide part 220 is rotated from the first position shown in FIGS. 8(*a*) and 9(*a*) toward the second position shown in FIGS. 8(*b*) and 9(*b*), the retained part 222B moves to the rear side of the retaining part 521 until the endface of the retained part 222B separates from the endface of the retaining part 521. When the endfaces separate, the coil spring 66 urges the movable guide part 220 to move leftward with the retained part 222B sliding along the rear side of the retaining part 521. Thus, the retained part 222B is in contact with the rear side surface of the retaining part 521. Consequently, the retaining part 521 restricts rotation of the movable guide part 220, thereby holding the movable guide part 220 in the second position (open state).

Once the movable guide part 220 has been rotated to the second position, nearly the entire conveying path P is exposed, as illustrated in FIG. 14. At this time, the user can easily remove a jammed sheet of paper, since the sheet is exposed.

Since the separating members 64 are disposed within the widthwise range of the movable guide part 220 in the embodiment, the separating members 64 can be exposed by rotating the movable guide part 220 to the second position. Accordingly, a sheet that becomes jammed near the separating members 64 can easily be removed. Further, the contact part 67A of the actuator 67 (see FIG. 3) is disposed downstream in the conveying direction from the distal ends 64A of the separating members 64. Hence, when a paper jam occurs (when a paper jam is detected), the paper can easily be removed since the leading edge of the sheet has advanced at least to the downstream side of the distal ends 64A of the separating members 64.

Further, the retaining part 521 can retain the movable guide part 220 in the second position in the embodiment. This facilitates the resolution of a paper jam, since the movable guide part 220 can be prevented from closing when removing the jammed paper.

Once a paper jam has been resolved, the user operates the operating parts 224 to rotate the movable guide part 220 back to the first position. At this time, the retained part 222B slides over the endface of the retaining part 521 when the user applies at least a prescribed force to the movable guide part 220 for moving the movable guide part 220 from the second position shown in FIGS. 8(*b*) and 9(*b*) to the first position shown in FIGS. 8(*a*) and 9(*a*), thereby disengaging the movable guide part 220 from the retaining part 521. When the movable guide part 220 is disengaged, the coil spring 66 urges the movable guide part 220 to automatically rotate into the first position. When the user subsequently rotates the movable guide part 220 to its closed position, the laser printer 1 is ready to perform image formation. Since the movable guide part 220 moves automatically to the first position when disengaged from the retaining part 521, the structure of the embodiment facilitates operations for clearing a paper jam.

Note that even if the user leaves the movable guide part 220 in the second position and rotates the top cover 20 from the open position to the closed position, the top cover 20 contacts the end of the movable guide part 220, as illustrated in FIG. 9(*b*). Thus, by pressing down on the top cover 20 with at least a prescribed force, the movable guide part 220 will disengage from the retaining part 521, just as when the user operates the operating parts 224 of the movable guide part 220 directly, and will rotate into the first position due to the urging force of the coil spring 66. In this way, the movable guide part 220 is returned to its first position, even if the user forgets to close the movable guide part 220 directly, thereby facilitating operations performed after clearing a paper jam.

If a sheet S becomes jammed between the process cartridge 50 and fixing unit 60 in the laser printer 1 of the embodiment, the user can rotate the top cover 20 into the open position and remove the process cartridge 50 from the main frame 10, as illustrated in FIG. 2. At this time, the user can extract the sheet S interposed between the heating roller 61 and pressure roller 62 through the access opening 11. When extracting the sheet S from between the process cartridge 50 and fixing unit 60, the sheet S contacts the coupling part 432 of the mounting guide ribs 431 and is bent around the coupling part 432 at a sharp angle. However, the coupling part 432 in the embodiment has a curved cross section and is elongated in the left-right direction. Thus, the coupling part 432 can guide the sheet S being pulled from the main frame 10 without tearing the sheet S.

The pre-fixing guides 311 and 321 provided in the embodiment (see FIG. 3) help to better guide a sheet S conveyed from the process cartridge 50 toward the nip position between the heating roller 61 and pressure roller 62. Accordingly, this structure reduces the likelihood of a paper jam occurring between the process cartridge 50 and fixing unit 60.

If water or another liquid is accidentally spilled in the vicinity of the first conveying guide 100 and second conveying guide 200 while the top cover 20 is in its open position, the liquid flows in the manner indicated by the bold arrow in FIG. 14 while the second conveying guide 200 is in the first position indicated by the double chain line. Thus, the second conveying guide 200 restrains the liquid from flowing directly onto the heating roller 61 (into the fixing unit 60). As shown in FIG. 14, the guide surface 110 slopes downward toward the downstream side of the conveying direction. Hence, liquid spilled on the second conveying guide 200 may flow onto the first conveying guide 100, but is retrained from flowing into the fixing unit 60. Further, integrally forming the first conveying guide 100 on the cover 400 in the embodiment restrains liquid from getting inside the space in which the thermistor 65 is disposed.

While the invention has been described in detail with reference to the embodiment thereof, it would be apparent to those skilled in the art that various changes and modifications may be made therein without departing from the spirit of the invention.

In the above-described embodiment, the coupling part 432 on the mounting guide ribs 431 provides a curved surface that extends continuously over substantially the entire left-right dimension of the cover 400, but the present invention is not limited to this configuration. For example, a curved surface having a prescribed width in the left-right direction may be provided intermittently at a plurality of positions in the left-right direction along the downstream ends of the mounting guide ribs 431. Alternatively, the coupling part may be configured of a plurality of ribs having curved surfaces and being situated close to each other in the left-right direction. Alternatively, the coupling part may possess rollers having a prescribed left-right dimension that are configured to rotate in contact with a sheet of paper.

The structure of the retaining part 521 described in the preferred embodiment is merely an example, and the present invention is not limited to this structure, provided that the retaining part can hold the movable guide part in the second position. For example, the retaining part may be moved or projected to a position capable of contacting the movable guide part through a user operation after the movable guide part has been moved from the first position to the second position.

In the embodiment, the fixed guide parts 210 include the first fixed guide part 210A and second fixed guide part 210B respectively disposed on the left and right sides of the movable guide part 220. However, a single fixed guide part may be provided on just one widthwise side of the movable guide part instead, for example.

In the embodiment, only part of the second conveying guide 200, and specifically the movable guide part 220, is configured to move relative to the main frame 10 between the first position and second position. However, the entire second conveying guide 200 may be configured to move relative to the main frame 10 between the first and second positions, for example.

While a plurality of operating parts 224 is provided in the embodiment for moving the movable guide part 220, a single operating part may instead be disposed on one widthwise end of the movable guide part.

In the above-described embodiment, the coil spring 66 is used as an example for urging the movable guide part 220 toward the first position. However, the urging member used to urge the movable guide part 220 toward the first position may be configured of a torsion spring or a leaf spring, for example. Alternatively, the urging member may be omitted.

Each set of discharge rollers 90R in the embodiment is configured of three rollers 91-93, but each set may be configured of two rollers instead, for example.

In the embodiment, the thermistor 65 is used as an example of the electronic part. However, the electronic part may be a thermostat or the like connected to the halogen lamp 61H for interrupting the flow of electricity to the halogen lamp 61H upon detecting a temperature exceeding a prescribed value.

The case 63 of the fixing unit 60 in the embodiment is primarily configured of the frame member 300 (support part), cover 400 (cover part), and roof member 500. However, the support part and cover part may be formed integrally, for example.

Further, the heating rotary body (heating member) of the present invention is not limited to a heating roller, but may be an endless belt or the like having flexibility. Similarly, the pressure rotary body is not limited to a pressure roller, but may be a belt-like member or the like.

The image-forming apparatus in the above-described embodiment is a laser printer 1 capable of forming only monochrome images, but the image-forming apparatus of the present invention may be a printer capable of forming color images. Further, the image-forming apparatus is not limited to printers, but may be a copy machine or multifunction peripheral provided with an original-reading apparatus, such as a flatbed scanner, for example.

What is claimed is:

1. An image forming apparatus comprising:

a main body;

a sheet discharge unit configured to discharge a sheet out of the main body;

a fixing unit including a heating member to thermally fix developer image deposited on the sheet to provide an image-fixed sheet; and a movable guide disposed near the heating member and defining at least a part of a conveying path for guiding the image-fixed sheet toward the sheet discharge unit, the movable guide being movable about a rotational shaft defining an axial direction and between a first position and a second position, the movable guide being configured to guide one surface of the image-fixed sheet in the first position, and the movable guide being configured to expose the conveying path in the second position;

a cover disposed on a top of the main body and configured to move between an open position in which the movable guide is exposed and a closed position in which the movable guide is covered, wherein the movable guide is disposed in the first position while the cover moves from the closed position to the open position; and a retaining part configured to retain the movable guide in the second position after the movable guide moves from the first position to the second position, the retaining part being a protrusion extending in the axial direction, wherein the movable guide has a retained part configured to contact the protrusion in a direction perpendicular to the axial direction, and wherein the movable guide is configured to be disengaged from the protrusion and move from the second position to the first position by receiving pressure from the cover when the cover moves from the open position to the closed position.

2. The image forming apparatus according to claim 1, further comprising an urging member configured to urge the movable guide toward the first position.

3. The image forming apparatus according to claim 1, wherein the movable guide includes an operating part allowing a user to move the movable guide.

4. The image forming apparatus according to claim 1, further comprising a fixed guide configured to guide end portions of the image-fixed sheet in a widthwise direction orthogonal to a conveying direction of the image-fixed sheet, the fixed guide being disposed adjacent to the movable guide in the widthwise direction, the fixed guide being configured to guide the image-fixed sheet toward the sheet discharge unit, the fixed guide being immovable relative to the main body.

5. An image forming apparatus comprising:

a main body;

a sheet discharge unit configured to discharge a sheet out of the main body;

a fixing unit including a heating member to thermally fix a developer image deposited on the sheet to provide an image-fixed sheet;

a movable guide disposed near the heating member and defining at least a part of a conveying path for guiding the image-fixed sheet toward the sheet discharge unit, the movable guide being movable about a rotational shaft defining an axial direction and between a first position and a second position, the movable guide being configured to guide one surface of the image-fixed sheet in the first position, and the movable guide being configured to expose the conveying path in the second position;

a cover disposed on a top of the main body and configured to move between an open position in which the movable guide is exposed and a closed position in which the movable guide is covered, wherein the movable guide is disposed in the first position while the cover moves from the closed position to the open position; and a retaining part configured to retain the movable guide in the second position after the movable guide moves from the first position to the second position, the retaining part being a protrusion having a general columnar shape extending in the axial direction, the protrusion having an outer peripheral surface, wherein the movable guide has a retained part configured to contact at least a part of the outer peripheral surface of the protrusion in a direction perpendicular to the axial direction, wherein the protrusion further has an end face perpendicular to the outer peripheral surface, wherein the retained part contacts the end face of the protrusion when the movable guide is disposed at the first position, and wherein the retained part contacts the at least a part of the outer peripheral surface of the protrusion when the movable guide is disposed at the second position.

6. The image forming apparatus according to claim 5, wherein the retained part is a projection protruding toward the protrusion of the retaining part in the axial direction.

7. The image forming apparatus according to claim 6, wherein the projection of the retained part is formed in a general arc-shape and has an outer surface and an end face, wherein the end face of the retained part contacts the end face of the protrusion when the movable guide is disposed at the first position, and wherein the outer surface of the retained part contacts the at least a part of the outer peripheral surface of the protrusion when the movable guide is disposed at the second position.

8. The image forming apparatus according to claim 5, further comprising an urging member configured to urge the movable guide toward the first position.

9. The image forming apparatus according to claim 5, wherein the movable guide is configured to be disengaged from the protrusion and move from the second position to the first position when the cover moves from the open position to the closed position.

10. The image forming apparatus according to claim 5, wherein the movable guide includes an operating part allowing a user to move the movable guide.

11. The image forming apparatus according to claim 5, further comprising a fixed guide configured to guide end portions of the image-fixed sheet in a widthwise direction orthogonal to a conveying direction of the image-fixed sheet, the fixed guide being disposed adjacent to the movable guide in the widthwise direction, the fixed guide being configured to guide the image-fixed sheet toward the sheet discharge unit, the fixed guide being immovable relative to the main body.

12. An image forming apparatus comprising:

a main body;

a sheet discharge unit configured to discharge a sheet out of the main body;

a fixing unit including a heating member to thermally fix a developer image deposited on the sheet to provide an image-fixed sheet; and a movable guide disposed near the heating member and defining at least a part of a conveying path for guiding the image-fixed sheet toward the sheet discharge unit, the movable guide being movable about a rotational shaft defining an axial direction and between a first position and a second position, the movable guide being configured to guide one surface of the image-fixed sheet in the first position, and the movable guide being configured to expose the conveying path in the second position;

a cover disposed on a top of the main body and configured to move between an open position in which the movable guide is exposed and a closed position in which the movable guide is covered, wherein the movable guide is disposed in the first position while the cover moves from the closed position to the open position;

a retaining part configured to retain the movable guide in the second position after the movable guide moves from the first position to the second position, the retaining part being a protrusion extending in the axial direction; and an urging member configured to urge the movable guide toward the protrusion of the retaining part in the axial direction, wherein the movable guide has a retained part configured to contact the retaining part in a direction perpendicular to the axial direction.

13. The image forming apparatus according to claim 12, wherein the movable guide is configured to be disengaged from the protrusion and move from the second position to the first position when the cover moves from the open position to the closed position.

14. The image forming apparatus according to claim 12, wherein the movable guide includes an operating part allowing a user to move the movable guide.

15. The image forming apparatus according to claim 12, further comprising a fixed guide configured to guide end portions of the image-fixed sheet in a widthwise direction orthogonal to a conveying direction of the image-fixed sheet, the fixed guide being disposed adjacent to the movable guide in the widthwise direction, the fixed guide being configured to guide the image-fixed sheet toward the sheet discharge unit, the fixed guide being immovable relative to the main body.

16. An image forming apparatus comprising:

a main body;

a sheet discharge unit configured to discharge a sheet out of the main body;

a fixing unit including a heating member to thermally fix a developer image deposited on the sheet to provide an image-fixed sheet; and a movable guide disposed near the heating member and defining at least a part of a conveying path for guiding the image-fixed sheet toward the sheet discharge unit, the movable guide being movable about a rotational shaft defining an axial direction and between a first position and a second position, the movable guide being configured to guide a first surface of the image-fixed sheet in the first position, and the movable guide being configured to expose the conveying path in the second position;

a fixed guide configured to guide end portions of the first surface of the image-fixed sheet in a widthwise direction orthogonal to a conveying direction of the image-fixed sheet, the fixed guide being disposed adjacent to the movable guide in the widthwise direction, the fixed guide being configured to guide the image-fixed sheet toward the sheet discharge unit, the fixed guide being immovable relative to the main body;

a cover disposed on a top of the main body and configured to move between an open position in which the movable guide is exposed and a closed position in which the movable guide is covered, wherein the movable guide is disposed in the first position while the cover moves from the closed position to the open position; and a retaining part configured to retain the movable guide in the second position after the movable guide moves from the first position to the second position, the retaining part being a protrusion extending in the axial direction, wherein the movable guide has a retained part configured to contact the retaining part in a direction perpendicular to the axial direction.

* * * * *